US012151143B2

(12) United States Patent
Gump

(10) Patent No.: US 12,151,143 B2
(45) Date of Patent: Nov. 26, 2024

(54) SPORTS TRAINING BALL HAVING EMBOSSED DESIGN

(71) Applicant: SWAX LAX LLC, Summit, NJ (US)

(72) Inventor: Laura Gump, Summit, NJ (US)

(73) Assignee: SWAX LAX LLC, Summit, NJ (US)

( * ) Notice: Subject to any disclaimer, the term of this patent is extended or adjusted under 35 U.S.C. 154(b) by 22 days.

(21) Appl. No.: 17/198,635

(22) Filed: Mar. 11, 2021

(65) Prior Publication Data

US 2021/0283468 A1 Sep. 16, 2021

Related U.S. Application Data

(60) Provisional application No. 62/988,564, filed on Mar. 12, 2020.

(51) Int. Cl.

| | |
|---|---|
| ***A63B 69/00*** | (2006.01) |
| ***A63B 37/06*** | (2006.01) |
| ***A63B 37/08*** | (2006.01) |
| ***A63B 37/12*** | (2006.01) |
| ***A63B 43/02*** | (2006.01) |
| *A63B 102/14* | (2015.01) |
| *A63B 102/18* | (2015.01) |
| *A63B 102/20* | (2015.01) |

(Continued)

(52) U.S. Cl.

CPC ..... *A63B 37/12* (2013.01); *A63B 37/06* (2013.01); *A63B 37/08* (2013.01); *A63B 69/0002* (2013.01); *A63B 2037/082* (2013.01); *A63B 2037/125* (2013.01); *A63B 2069/0006* (2013.01); *A63B 2102/14* (2015.10); *A63B 2102/18* (2015.10); *A63B 2102/182* (2015.10); *A63B 2102/184* (2015.10); *A63B 2102/20* (2015.10); *A63B 2102/22* (2015.10); *A63B 2102/26* (2015.10); *A63B 2102/32* (2015.10); *A63B 2102/34* (2015.10); *A63B 2209/00* (2013.01); *A63B 2243/0033* (2013.01)

(58) Field of Classification Search

CPC .... A63B 37/12; A63B 37/06; A63B 2037/082
USPC ..... 473/451, 598, 600–602, 596
See application file for complete search history.

(56) References Cited

U.S. PATENT DOCUMENTS 465,507 A 12/1891 Windows
1,609,493 A * 12/1926 Nye ..... A63B 39/08 473/600

(Continued)

FOREIGN PATENT DOCUMENTS

CN 201211415 Y 3/2009
WO WO 02/089925 A1 11/2002

(Continued)

OTHER PUBLICATIONS

"The Engineering Toolbox: Densities of Common Materials," <https://www.engineeringtoolbox.com/density-materials-d_1652.html>, retrieved on Jul. 3, 2018. (6 pages).

(Continued)

*Primary Examiner* — Mitra Aryanpour
(74) *Attorney, Agent, or Firm* — Fox Rothschild, LLP

(57) ABSTRACT

A sports training ball is disclosed that is made up of a shell having an embossed design that defines an enclosure having an interior volume substantially occupied by a filler that includes a mixture of a first material, a second material, and a third material.

20 Claims, 18 Drawing Sheets

(51) Int. Cl.

| | |
|---|---|
| *A63B 102/22* | (2015.01) |
| *A63B 102/26* | (2015.01) |
| *A63B 102/32* | (2015.01) |
| *A63B 102/34* | (2015.01) |

(56) References Cited

U.S. PATENT DOCUMENTS

| | | | | |
|---|---|---|---|---|
| 1,890,566 | A | 12/1932 | Bartky et al. | |
| 1,923,359 | A | 8/1933 | Fegan | |
| 1,960,803 | A | 5/1934 | Baumer | |
| 1,994,703 | A | 3/1935 | Hawes | |
| 2,006,861 | A | 7/1935 | Grady | |
| 2,078,141 | A | 4/1937 | Hesper | |
| 2,081,531 | A * | 5/1937 | Fegan | A63B 37/00 473/602 |
| 2,093,737 | A | 9/1937 | Reach | |
| 2,138,004 | A * | 11/1938 | Grau, Jr. | B29D 99/0042 473/600 |
| 2,494,806 | A | 1/1950 | Gibson | |
| 2,840,024 | A | 6/1958 | Haas | |
| 3,069,170 | A | 12/1962 | Dillon, Jr. | |
| 3,480,280 | A | 11/1969 | Gamertsfelder | |
| 3,805,720 | A | 4/1974 | Hunt | |
| D232,957 | S | 9/1974 | Kahelin | |
| 4,151,994 | A | 5/1979 | Stalberger, Jr. | |
| 4,256,304 | A | 3/1981 | Smith | |
| 4,354,679 | A | 10/1982 | Steinmetz | |
| 4,448,418 | A | 5/1984 | McNeill | |
| D288,461 | S | 2/1987 | Hirai | |
| 4,643,424 | A | 2/1987 | Nakajima | |
| D292,014 | S | 9/1987 | Stalberger | |
| 4,872,676 | A | 10/1989 | Townsend | |
| 4,880,233 | A | 11/1989 | Song | |
| 4,943,055 | A | 7/1990 | Corley | |
| 4,943,066 | A | 7/1990 | Lathim et al. | |
| 5,007,639 | A | 4/1991 | Watson et al. | |
| 5,040,795 | A | 8/1991 | Sonntag | |
| 5,286,020 | A | 2/1994 | Caruso | |
| 5,310,178 | A | 5/1994 | Walker | |
| 5,324,042 | A | 6/1994 | Demas | |
| 5,429,351 | A | 7/1995 | Hanson | |
| 5,492,320 | A | 2/1996 | Hoffman et al. | |
| 5,566,953 | A | 10/1996 | Arriola | |
| 5,655,777 | A | 8/1997 | Neading et al. | |
| 5,688,198 | A | 11/1997 | Teifert | |
| 5,711,729 | A | 1/1998 | Chan | |
| 5,772,543 | A | 6/1998 | Paino | |
| 5,788,591 | A | 8/1998 | Decker | |
| 5,813,932 | A | 9/1998 | Grafton | |
| 5,820,501 | A | 10/1998 | Soofi | |
| 5,830,034 | A | 11/1998 | Ciechanowski et al. | |
| 5,848,946 | A | 12/1998 | Stillinger | |
| 5,851,161 | A | 12/1998 | Sassak | |
| 5,893,808 | A | 4/1999 | Bennett | |
| 5,893,811 | A | 4/1999 | Stover et al. | |
| 5,910,059 | A | 6/1999 | Hanson | |
| 6,012,997 | A | 1/2000 | Mason | |
| D422,040 | S | 3/2000 | Stalberger | |
| 6,053,829 | A | 4/2000 | Conley | |
| 6,393,992 | B1 * | 5/2002 | Vasel | F41B 15/02 473/577 |
| 6,645,098 | B1 | 11/2003 | Quinn | |
| 6,663,520 | B2 | 12/2003 | Ou Chen | |
| D500,104 | S | 12/2004 | Lowinger | |
| 7,211,012 | B2 | 5/2007 | Laliberty et al. | |
| 7,247,107 | B1 | 7/2007 | Bedwell | |
| 7,566,488 | B2 | 7/2009 | Mimura | |
| 7,785,219 | B2 | 8/2010 | Avis | |
| 8,277,344 | B2 | 10/2012 | Cea et al. | |
| 8,475,304 | B2 * | 7/2013 | Ou | A63B 45/00 473/597 |
| 8,708,843 | B1 * | 4/2014 | Sekac | A63B 43/002 473/600 |
| 10,478,677 | B2 * | 11/2019 | Gump | A63B 37/06 |
| 10,512,824 | B2 * | 12/2019 | Gump | A63B 43/00 |
| 10,561,915 | B1 * | 2/2020 | McGuiness | A63B 37/12 |
| 10,773,133 | B2 * | 9/2020 | Fang | A63B 45/00 |
| 2004/0018901 | A1 | 1/2004 | Morrow | |
| 2004/0102265 | A1 | 5/2004 | Laliberty et al. | |
| 2004/0142779 | A1 | 7/2004 | Chan | |
| 2004/0142780 | A1 | 7/2004 | Estefano | |
| 2005/0143205 | A1 * | 6/2005 | Yang | A63B 37/02 473/601 |
| 2005/0239584 | A1 * | 10/2005 | Willyerd | A63B 69/0002 473/600 |
| 2008/0020874 | A1 * | 1/2008 | Huang | A63B 37/02 473/602 |
| 2008/0051233 | A1 | 2/2008 | Nesbitt | |
| 2008/0057331 | A1 * | 3/2008 | Barrar | A63B 45/00 428/542.4 |
| 2008/0064535 | A1 * | 3/2008 | Herman | A63B 37/00 473/446 |
| 2008/0194362 | A1 * | 8/2008 | Helmer | A63B 37/00 473/597 |
| 2008/0242458 | A1 * | 10/2008 | Winn | A63B 41/00 473/594 |
| 2009/0137350 | A1 | 5/2009 | Lenig | |
| 2009/0209374 | A1 | 8/2009 | Ou | |
| 2011/0165978 | A1 | 7/2011 | Leefeldt | |
| 2011/0226824 | A1 | 9/2011 | Altavilla | |
| 2011/0312433 | A1 * | 12/2011 | Parenti | A63B 69/0002 473/422 |
| 2012/0142464 | A1 * | 6/2012 | Smith | A63B 37/14 473/597 |
| 2013/0109513 | A1 | 5/2013 | Fernandez | |
| 2014/0342859 | A1 | 11/2014 | Newman | |
| 2014/0357149 | A1 | 12/2014 | Canobbio | |
| 2015/0045152 | A1 | 2/2015 | Hayes | |
| 2015/0328500 | A1 | 11/2015 | Hanson | |
| 2016/0354666 | A1 | 12/2016 | Greenwalt | |
| 2016/0375317 | A1 * | 12/2016 | Connelly | A63B 69/38 473/606 |
| 2018/0008868 | A1 * | 1/2018 | Gump | A63B 45/00 |
| 2018/0064999 | A1 * | 3/2018 | Gump | A63B 37/08 |
| 2018/0345108 | A1 * | 12/2018 | Mueller | A63B 69/0002 |
| 2020/0070009 | A1 | 3/2020 | Gump et al. | |
| 2020/0086178 | A1 | 3/2020 | Gump | |
| 2020/0269096 | A1 * | 8/2020 | Kuo | B65H 54/70 |
| 2021/0283468 | A1 * | 9/2021 | Gump | A63B 69/0002 |

FOREIGN PATENT DOCUMENTS

| | | |
|---|---|---|
| WO | WO 2008/097711 | 8/2008 |
| WO | WO 2013/006940 | 1/2013 |
| WO | WO 2016/118846 | 7/2016 |

OTHER PUBLICATIONS

Campbell, Andrea, "The Great American Pastime: Baseball, Origins and Features", Bright Hub Education [online], Apr. 2014 [retrieved on Jul. 6, 2017]. Retrieved from the internet: <URL:http//www.brighthubeducation.com/social-studies-help/128534-origins_and_features-of-baseball/ > (3 pages).

"Hybrid Juggle Balls", Flying Clipper Juggling Supplies, Product Catalog, www.flyingclipper.com/tossaball-hybrid-juggling-balls, (Last accessed Nov. 13, 2017) (3 pages).

* cited by examiner

SPORTS TRAINING BALL HAVING EMBOSSED DESIGN

CROSS-REFERENCE TO RELATED APPLICATION

This application claims the benefit of priority of U.S. Patent Provisional Application No. 62/988,564, filed Mar. 12, 2020. The entire contents of which are incorporated herein by reference in its entirety.

FIELD OF THE DISCLOSURE

This disclosure relates to a sports training ball having embossed design for grip and ease of use.

BACKGROUND

The present disclosure describes technology related to a ball for use in a sporting activity. The technology is well suited for use in "hard-ball" sports such as baseball, softball, lacrosse, and field hockey. Through the use of the techniques disclosed herein, a sporting goods manufacturer can generate sports balls that have advantages over those currently available. Such advantages include impact-absorbing qualities, softness, durability and improved safety for players. Sports balls with these qualities are able withstand repeated impacts that occur during training while also being less likely to cause injury upon impact and accordingly are better suited for training.

Injuries are one of the big obstacles to overcome in getting young people involved in sports. This is especially true for sports that involve playing with balls that have hard covers or hard outer surfaces. It is not unusual in such sports for inexperienced players to either misdirect the ball so that it strikes someone else or to lose track of the flight of the ball and inadvertently be struck by it. Each of these circumstances can result is significant injuries to players or bystanders of a sport.

The risk of such injuries can cause novices (especially children) to forego a sport altogether or, in the event that they do try to learn the sport, to have a more difficult time learning the sport due to a fear of being hit. Anxieties among novice players can be detrimental to the growth of popularity of a sport. Lacrosse is an example of a sport the popularity of which is growing but may be limited because it is played with a hard, heavy rubber ball. The hard balls used in baseball and softball also can cause anxiety in novice players. Some players are less likely to take up a sport, such as lacrosse, baseball or softball, due to the fear of being hurt by the ball. Sports balls that absorb impacts when they make contact reduce the importance of such protective equipment and thus may encourage greater participation in the sport.

A need exists for a sports training ball that flies and throws as a regulation ball but absorbs impact in the event of a collision. Such sports training balls allow players of the game to train in a safe and confident manner. To meet these requirements a ball needs to meet the specification of the game's governing body with regard to aerodynamic and physical (e.g., weight, air-resistance, and circumference) properties so that the training balls are similar to a ball that would be used in an official competition. However, for training purposes such a ball should absorb impact so as to minimize harm to players if or when they are struck and thereby minimize the anxieties of new players. Furthermore, a sports ball for use in training must be designed and built to maintain impact-absorption and aerodynamic properties through numerous impacts and through demanding usage.

SUMMARY OF THE DISCLOSURE

A sports training ball is disclosed herein. The training ball may be a baseball, softball or sliotar. The training ball may be a regulation-size ball (e.g., regulation-size baseball, or regulation-size softball) or a heavy ball or a lite ball. The training ball may be hand-sewn or machine made. The training ball comprises a shell defining an enclosure having an interior volume, the shell including a plurality of pads connected along a plurality of seams sewn with a thread having a finishing knot; and a composite filler that includes a mixture of a first material and a second material comprising a plurality of grains of sand, wherein the filler substantially occupies the interior volume, and the sports ball has an embossed design on one or more of the pads. The filler may comprise a third material being different from the first material and the second material. The first material may be a ground elastic material selected from the group consisting of a polyisoprene, latex, natural rubber, and synthetic rubber. The third material may be dry wood dust, birdseed, gravel, beads, feathers, rice or any combination thereof.

Also disclosed herein is a method of making the sports training ball.

DETAILED DESCRIPTION

Figure 1:
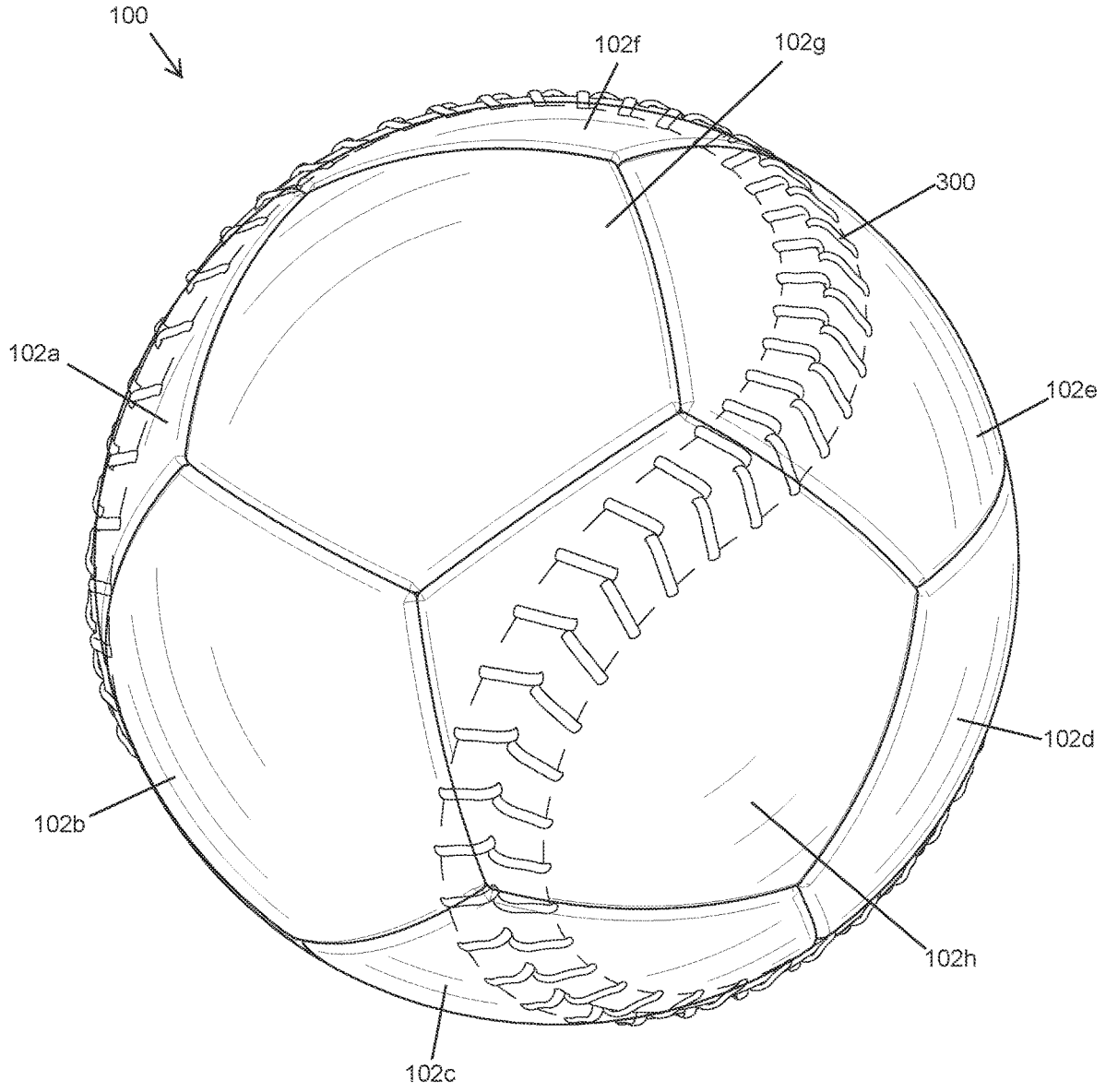
FIG. 1 is an isometric top view of a sports training ball of the disclosure having 12 pentagonal pads and embossed lacing.

The present invention incorporates by reference in entirety co-owned U.S. Patent Publication No. 20180008868 (titled: Sports training ball and method of manufacturing a sports training ball) and U.S. Patent Publication No. 20180064999 (titled: Sports training ball with enhanced gripping surface), both of which are assigned to and owned by SWAX LAX LLC. The method of assembling the ball, as well as various components of a ball useful with the present invention is disclosed therein.

An important aspect of the sports training balls disclosed herein is their durability. That durability is necessary to withstand the rigors of training in sports such as baseball and softball. Unlike other sewn balls, sports training balls for baseball and softball require a strong thread and a particular method of tying off the thread so that, in the event that the fabric of the ball surface fails, the thread will not fail. This design feature, as described in co-owned U.S. Patent Publication No. 20180008868, is particularly important in developing a sports training ball that can withstand multiple consecutive throws and collisions (e.g., with a bat and/or against a goal post and/or a wall) of greater than 70 mph (professional players can hit a ball at speeds in excess of 100 M.P.H.) as is required in these sports.

In addition to the durability of sports training balls as disclosed herein, a further advantageous quality relates to the lack of recoil upon impact in comparison to regulation lacrosse balls. Regulation lacrosse balls have a tendency to bounce and roll when they hit the ground or cross bar of a goal. Sports training balls as described herein tend not to roll away and to stay closer to the training area in comparison resulting in less time spent chasing balls during practice. This is due to the design of the outer shell being quilted as opposed to smooth rubber as in the regulation lacrosse ball. One advantage of the baseball having less bounce than a regulation ball is that it is easier to field (scoop up into your mitt or throwing hand) so players are less fearful of putting their body in front of it. This is true for experienced players as well as those who train indoors.

Training balls made from the outer shell layers of the invention are particularly useful for indoor training where grass or artificial turf is not available, for example, surfaces such as hardwood gym floors and have the advantage of not marking the floors as regulation balls are prone to do. Other advantages include not denting the floors, walls and bleachers, and avoiding the chaos associated with balls bouncing all over the space if a pass is missed by a player, or ricochets off a wall or other object. Another advantage is that the sports balls don't ricochet off the ground into the face or body of a young player when fielding ground balls. Overall, indoor training and play, as well as outdoor, is greatly improved.

Definitions

The terms "sports ball" or "sports training ball" as used herein refers to a ball used in a sport or for a similar entertainment purpose. In certain embodiments, a sports ball as disclosed herein may be used for baseball, softball, hurling, golf, or lacrosse. The sports ball may be a regulation size ball, heavy ball, mini ball, or made in any other desired size. In other embodiments, a sports ball as disclosed herein may be used for other sports such as field hockey, handball, team handball, rounder's, cricket, polo, jai alai, hurling, ice hockey, indoor roller hockey, street hockey, or similar sports. In certain other sports, collisions between players and equipment (such as pucks, balls, and the like) may also cause injury. It should be understood that the techniques as described herein may be applied to other geometries than balls, for example pucks and the like. In an embodiment, the sports training ball is a baseball, optionally of regulation size and weight. In another embodiment, the sports training ball is a softball, optionally of regulation size and weight. In another embodiment, the sports training ball is a hurling ball (also known as a sliotar), optionally of regulation size and weight.

As used herein, the words "section(s) of a shell", "pad" or "pads" are used interchangeably with the words "panel" or "panels" or "pouch" or "pouches".

The terms "softer" or "harder" as used herein refer to the relative hardness of different materials. The hardness of materials (e.g., polymers, rubbers, and elastomer) is measured in various ways, for example by the Rockwell hardness test or the Shore (Durometer) hardness test. Such methods measure the resistance of the material toward indentation and provide an empirical value that corresponds to the quality of hardness or softness of a tested material. In addition, as used herein, density refers to the mass of a material divided by its volume.

"Compression" as used herein refers to the results of ASTM F 1888 Compression-Displacement Tests conducted on the balls of the present disclosure.

"Coefficient of Restitution (COR)" refers to the results of ASTM F 1887 Measuring the Coefficient of Restitution (COR) Tests conducted on balls of the present disclosure.

"Coefficient of Friction" is per the NOCSAE football receiver glove standard ND019.

"Regulation" sports ball means a ball of a chosen sport which meets the guidelines of the governing body for that sport, e.g., the National Baseball League for baseball and The International Softball Federation for softball.

The regulation or official specification for manufacturing a baseball is that it should be made out of two pieces of cowhide or horsehide, stitched tightly together using 108 double stitches (or 216 single stitches) by hand. Under the current rules, a major league baseball weighs between 5 and 5¼ ounces (142 and 149 g), and is 9 to 9¼ inches (229-235 mm) in circumference and 2.86-2.94 inches (73-76 mm) in diameter.

A regulation softball is about 12 inches (about 30 cm, or about 305 mm to about 308 mm) in circumference (or about 11 inches to about 12 inches for slow-pitch), with a weight of about 177 to about 198 grams (about 6.25 to about 7.0 ounces). Softball recreational leagues for children may use 11-inch balls (referred to herein as a "youth softball") until they transition to a 12-inch ball. These youth softballs may be about 10.8 inches to about 11.2 inches in circumference, about 3.4 to about 3.6 inches in diameter, and with a weight of about 167 to about 174 grams.

A sliotar (or a sliothar) is a hard solid sphere slightly larger than a tennis ball, consisting of a cork core covered by two pieces of leather stitched together. Sometimes called a "puck" or "hurling ball", it resembles an American baseball with more pronounced stitching. It is used in the Gaelic games of hurling, camogie, rounders and shinty.

GAA (Gaelic Athletic Association) requires the sliotar to have a diameter between 69 and 72 mm (2.7 and 2.8 in) not including the rib, and a mass between 110 and 120 g (3.9 and 4.2 oz). The rib height is between 2 mm and 2.8 mm, and width between 3.6 mm and 5.4 mm. The leather cover can be between 1.8 mm and 2.7 mm and is laminated with a coating of no more than 0.15 mm.

"Embossed" refers to a design, pattern, mark, or the like that has been carved, molded, printed, stamped, or any combination of the same, on a surface or object. "Synthetic leather" or "artificial leather" refers to a manmade, polymeric material that generally resembles leather in appearance, but which has a surface designed to provide gripping due to its enhanced frictional characteristic (coefficient of friction) and relative "tackiness" as compared to artificial leather that does not provide similar characteristics. The term artificial leather includes, without limitation, artificial suede, artificial microfiber and artificial velour types. Such polymeric material used to make the artificial leather includes polyurethanes, polyesters, poly acrylics, polyolefins, nylons and combinations thereof, such as mixtures, homo-polymers and copolymers of these materials. The sports training ball made in accordance with in the present invention may include one or more of the following materials in the outer shell layer(s): KR GRIPPE PU material (available from Korea); Amara synthetic suede; WRP-7400P by Japanese Teijin Cordley.

Outer Shell Layer(s)

The sports training balls of the present invention may include an outer shell layer. This layer (component) of the sports ball may be made from a synthetic leather that optionally has a surface "tackiness" (frictional resistance (coefficient of friction)) which allows for enhanced gripping of the ball by the equipment used (e.g., lacrosse strings, field hockey stick, jai alai basket, indoor hockey ball) or by the hand (e.g., baseball, softball, baseball glove, softball glove, sliotar).

The weight and size (circumference) of the inventive ball may substantially match those of a regulation sports ball. In an embodiment, the weight and size (circumference) of the inventive ball may substantially match those of a regulation baseball, softball or sliotar. In another embodiment, the inventive ball may be designed to meet the regulation weight and size of a ball used in another sport, such as lacrosse, golf, ice hockey or field hockey.

A softball training ball disclosed herein may be about 10 inches to about 12.5 inches, about 10.5 to about 11.25 inches (e.g., for youth), or about 12 inches to about 12.125 inches (about 30 cm) in circumference. A softball training ball disclosed herein may have a weight of about 110 to about 200 grams, about 160 to about 200 grams, about 165 to about 175 grams (e.g., for youth), or about 177 to about 198 grams (about 6.25 to about 7.0 ounces). The softball training ball weighing about 177 to about 198 grams and having a circumference of about 12 inches to about 12.125 inches (about 30 cm) may be referred to as a "regulation-size softball." The softball training ball weighing about 165 to about 175 grams and having a circumference of about 10.8 inches to about 11.1 inches may be referred to as a "youth softball" or "youth-size softball."

A baseball training ball disclosed herein may weigh about 1.5 ounces to about 20.0 ounces, about 1.5 ounces to about 12.0 ounces, about 3.0 to about 20.0 ounces, about 1.5 ounces to about 4.5 ounces, about 3.0 ounces to about 4.0 ounces, about 10.0 ounces to about 20.0 ounces, about 12.0 ounces to about 15.0 ounces, or about 5 ounces to about 5¼ ounces. A baseball training ball disclosed herein may be about 8.7 ounces to about 9.5 inches, or about 9 to about 9¼ inches in circumference. A baseball training ball disclosed herein may weigh between about 5 ounces and about 5¼ ounces (about 142 and about 149 g), and about 9 to about 9¼ inches (about 229-about 235 mm) in circumference (about 2⅞-about 3 inches or about 73-about 76 mm in diameter), and referred to as a "regulation-size baseball."

A sliotar training ball disclosed herein may weigh between about 110 and about 120 g (about 3.9 and about 4.2 oz), and is about 69 to about 72 mm (about 2.7 to about 2.8 in) in diameter, not including the rib. In this case, the sliotar training ball may be referred to as a "regulation-size sliotar."

The inventive ball may be designed to have a weight and size of any desired amount, or substantially matching any commonly known or used ball. The ball may be designed to be smaller, larger, heavier or lighter than the regulation ball of that sport. For example, the inventive softball may be designed to be about 10 inches to less than 12 inches in circumference and to weigh less than about 177 grams, e.g., about 160 to about 176 grams, about 150 to about 170 grams, or about 140 to about 165 grams. In another embodiment, the inventive training ball may be substantially the same size as the regulation sports ball but heavier, referred to herein as a "heavy ball." The heavy ball may have an average weight about 12% to about 18% heavier, or preferably about 15% heavier, than the regulation sports ball. Much like when a baseball player warms up with a weighted bat during batting practice, the sports player may use a heavy ball to practice hitting and throwing. In another embodiment, the sports training ball may be substantially the same size as the regulation sports ball but lighter, referred to herein as a "lite ball." A heavy baseball may weigh about 12 ounces to about 20 ounces. A lite baseball may weigh about 1.5 ounces to about 4 ounces, or about 3 ounces to about 4 ounces.

In yet another embodiment, the weight and/or size (circumference) of the inventive training ball may be decreased, for example this mini ball may be about ¾ to about ⅞ the size of the regulation sports ball. The surface of the ball may be made up of a shell with twelve sections and each of the sections may be shaped as a pentagon.

The shell weight, either having a single layer or multiple layers, may be in the range of about 10 g to about 40 g, about 12 g to about 35 g, or about 15 g to about 33 g. The shell weight may be about 20 g, about 25 g, about 26 g or about 33 g. The shells used for making the balls of the present invention provide the player with the "feel" of a regulation sports ball, but with substantially less hardness, and more compression.

The shell sections (pads or panels) may be of any shape (for example, a pentagon, triangle, hexagon, square, or rectangle) having been cut by any suitable means, e.g., a hydraulic press (for example, a clicker press) that is instrumented with an appropriate cutting dye that is used to cut the material. Sewing holes may also be punched in the material in preparation for sewing the sections together to form the ball. In certain embodiments, such as the embodiment illustrated in FIGS. 1-8, the sections are shaped as regular pentagons (that is, all sides are equal), with each side having a length of e.g., about 1.2 inches. Such embodiments provide the advantageous geometrical properties of a regular dodecahedron. In certain embodiments, such as the embodiment illustrated in FIGS. 9-16, the sections are shaped as squares and hexagons. The outer shell layer may comprise any number of pads or panels, including but not limited 2-64, 2-20, 2-14, 4-14, 10-14, 2, 4, 6, 8, 10, 12, 14, 16, 18, or 20 pads or panels. In an embodiment, the outer shell layer may comprise 2, 4, 6, 8, 12 or 14 pads or panels.

In certain embodiments, the surface of the sports training ball is made up of twelve shell sections and each of the sections is shaped as a regular pentagon. The ball may be a regular dodecahedron. In another embodiment, the surface of the sports training ball is made up of shell sections shaped as squares, hexagons, or a combination thereof, optionally totaling in 4-14, 10-14 or 14 shell sections. In another embodiment, the surface of the sports training ball is made up of shell sections shaped as triangles, squares, hexagons, or a combination thereof, optionally totaling in 4-14, 10-14 or 14 shell sections.

The outer shell of a sports training ball in accordance with the disclosure may comprise an embossed pattern on its surface. The pattern may be embossed in the form of a geometric shape or in the shape of stitched lacing. The pattern may be designed to look like the stitched lacing on a conventional baseball or softball or sliothar. One such pattern may be a designed to look like the lacing on a regulation baseball, as shown, e.g., in FIGS. 1-16, with panels of any shape and size. This lacing may be embossed in red on a white sports training ball. The lacing may be embossed in any desired color.

The embossed pattern may be raised and/or textured such that the player can feel the placement of the inventive training ball in his/her hand without looking at the ball. This is particularly important in sports such as, baseball, softball and hurling, where the pitcher uses the lacing to position the ball in hand.

The inventive baseball training ball may have an embossed pattern identical to the red lacing/stitching on a conventional baseball. It aligns from a design standpoint with traditional baseballs in the marketplace, adhering to the sport's tradition. For developing players, it allows for the training on finger placement for throwing fundamentals, given the subtle feel of the embossed stitching. The stitching placement establishes what a developing player will eventually see/use in the sport as he/she moves to a regulation ball.

When each of the twelve pentagonal sections is sewn in position on an inventive sports training ball, the portion of each regular pentagon that is visible on the surface of the ball and may have sides that are each 1 inch in length. In this case, the remaining 0.2 inches of length for each side of the pentagons are inside the ball as can be seen in FIGS. 5B-5C of U.S. Patent Publication No. 20180008868, incorporated herein by reference in its entirety.

The shells may include one or more layers of material. For example, an outer layer may be laminated or otherwise joined with an additional layer of artificial material such as synthetic leather, e.g. synthetic suede, or in some instances laminated with a woven textile material, such a cotton, polyester fabric, or latex. In an embodiment, the outer layer may be a synthetic leather, and the laminate may be latex, which adheres the outer layer to an additional (inner) layer. An outer shell may be made from a single layer of a synthetic leather, dyed or not dyed, to be of any desired color.

Figure 17:
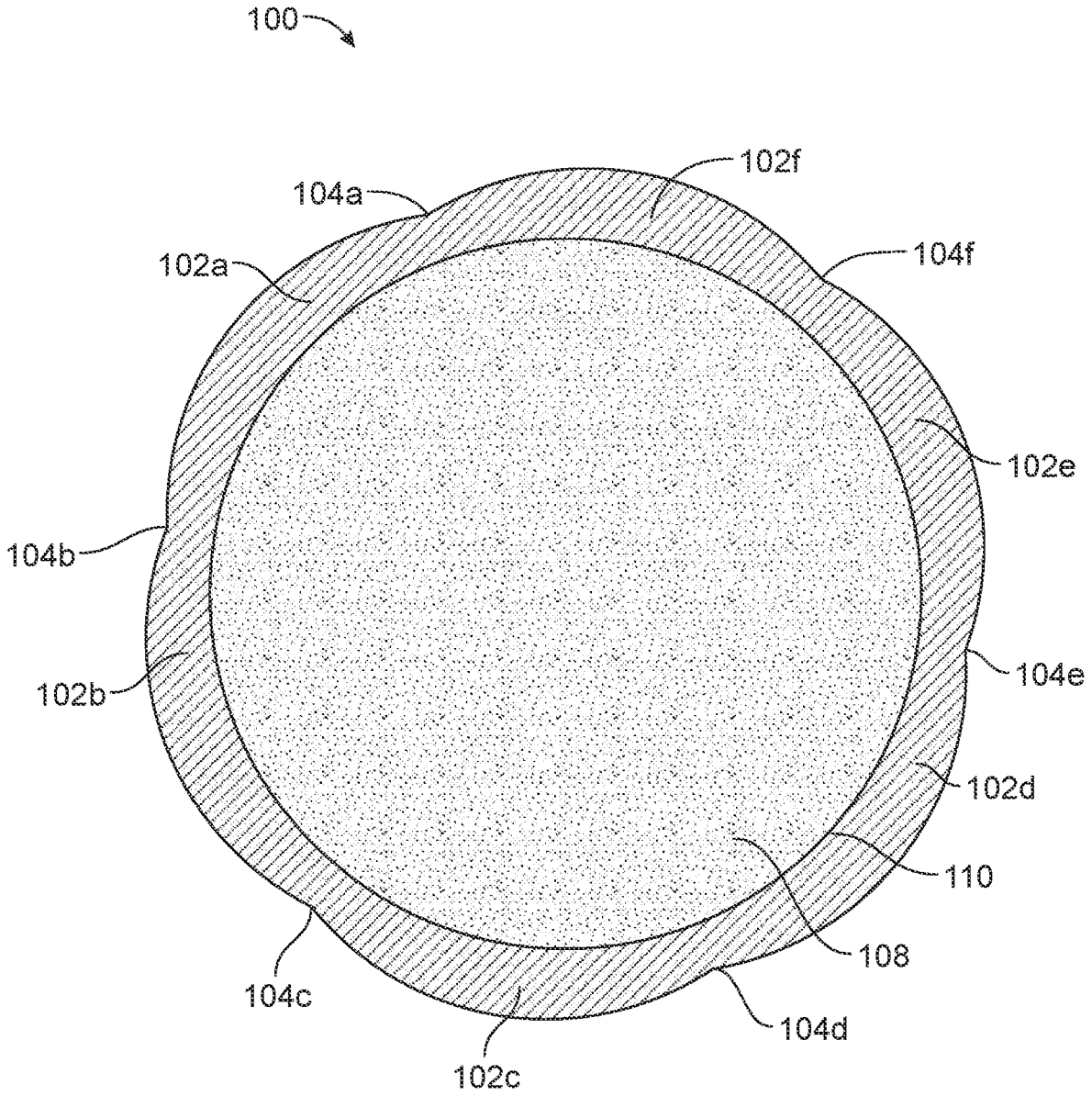
FIG. 17 is a side cross-sectional view of the sports ball as shown in FIG. 1.

Referring now to the drawings wherein aspects of the subject application are shown, FIGS. 1-8 and 17 are various views of a sports ball 100 in accordance with an embodiment of the present disclosure. FIGS. 1-8 show an exterior of the sports ball and FIG. 17 shows a cross-sectional view of the sports ball. The sports ball illustrated in FIGS. 1-8 and 17 has an outer surface made up of twelve shell sections each of which has a pentagonal shape. Sections 102*a*-102*h* making up the cover of the sports ball are visible in FIGS. 1 and 17. Note that all of the shell section that are not visible in any one figure, because they are on the opposite side of the sports ball from the perspective shown. It will be understood by a skilled practitioner that other numbers of sections or shapes of sections may be used in the design of other embodiments of sports balls in accordance with the present disclosure. An embossed lacing design 300 is also shown in FIG. 1.

The twelve shell sections of FIGS. 1-8 and 17 are connected by a plurality of seams that are sewn with a thread. There is a single seam that connects each pad on each of its five sides to its five neighboring (or adjacent) sections. A completed twelve-sided (that is, twelve sections) ball with pentagonal sections has a total of 12 seams connecting sections together. In an embodiment, the seams are sewn with thread such as bees waxed nylon thread or polyester thread. In an embodiment, multi-ply (e.g., 3-ply, 4-ply, or 5-ply) nylon thread may be used. In another embodiment, double-stitching is used resulting in still stronger tension (e.g., 12-ply).

FIG. 17 provides a cross-sectional view of the ball illustrated in FIGS. 1-8. Shown in FIG. 17 is six sections 102*a*-102*f* each with a respective seam 104*a*-104*f* connecting it to one of its five neighbors. FIG. 17 also illustrates an interior volume 110 that is substantially filled with a filler 108 as further described herein. In an embodiment as indicated in FIG. 17 the filler provides mechanical stability to the training ball while also providing sufficient mass so that the training ball will have the appropriate mass or weight for the sport for which it is being used. As will be understood by a skilled practitioner, the specific materials and quantity of materials used must be selected to suit the specific sport for which a training ball is being provided. It should be noted that the scope of the present disclosure allows sufficient flexibility to accommodate variations in sports ball regulations as are adopted from time to time by relevant governing bodies.

Figure 18:
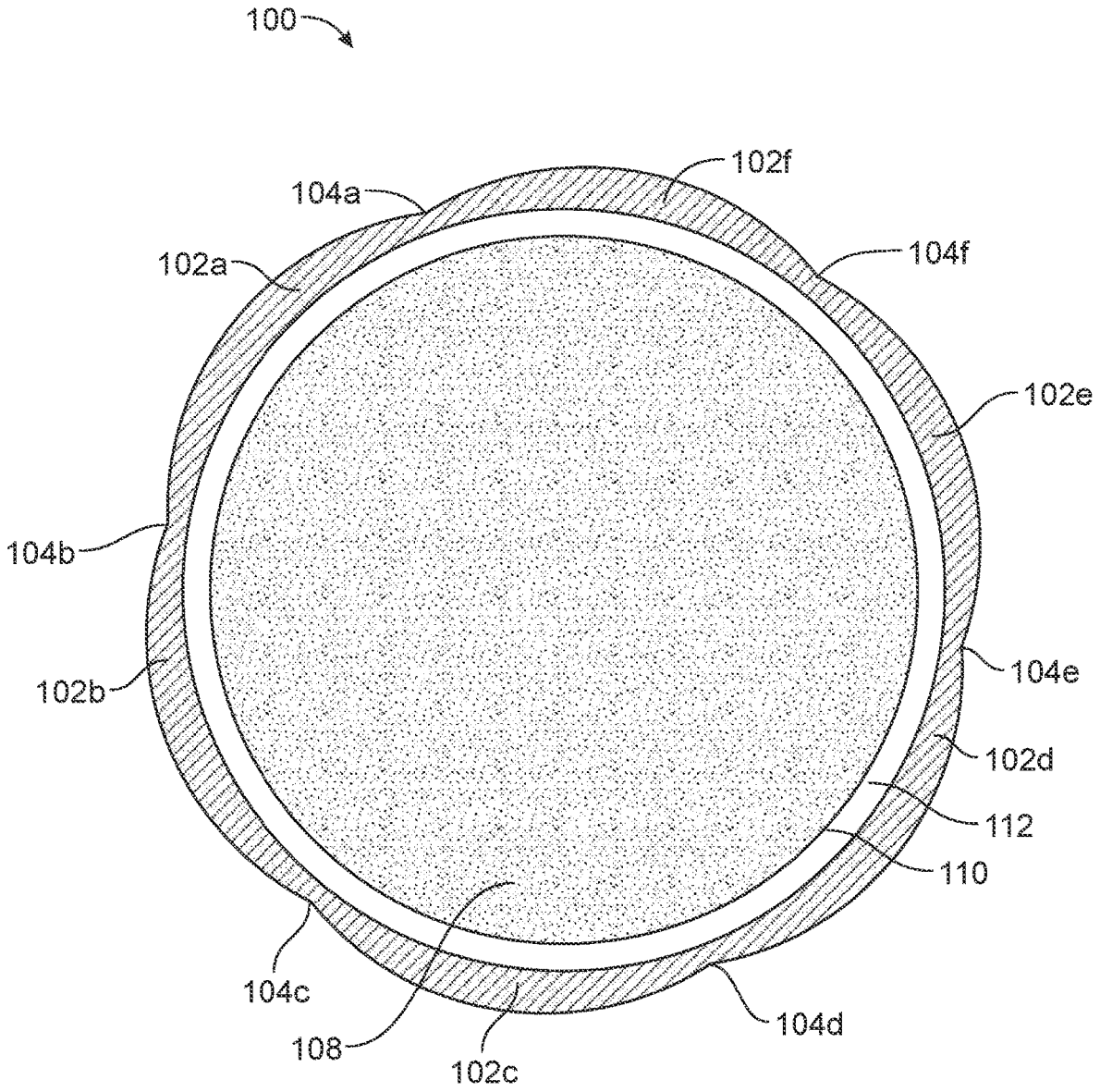
FIG. 18 is a side cross-sectional view of the sports ball as shown in FIG. 1 with an additional layer laminated to the outer shell.

FIG. 18 is a cross-sectional view of the ball illustrated in FIG. 1 showing an additional layer 112 laminated to the shell sections. As further described herein, the outer shell may be joined with one or more additional layers to provide strength or impart other properties to the ball. Desirably, a flexible adhesive (not shown), such a natural or synthetic latex adhesive, is used to join the layers, although other methods such as heat, sewing or the like may be employed. The additional layers may serve to prevent leakage of the fine filler material when the ball is struck against hard surfaces. As further described herein, the additional layers may be selected from a variety of materials including non-woven polymeric materials such artificial leather materials, and in particular non-woven artificial suede, as well as natural and synthetic woven textile materials, such as cotton or polyester fabrics. The filler material 108 in this embodiment as well as other embodiments, typically 108 includes more than one material with each having a different density as further described herein.

An outer shell made from a multi-layer cover includes one or more layers of a synthetic non-woven leather laminated to one of more layers of a synthetic suede (for example, Amara material or 150 grams PV fabric). The synthetic non-woven leather may be the outer layer or the inner layer, with the synthetic suede being the other. When the synthetic non-woven leather is the outer layer, it may comprise a surface coating thereon, optionally a polymer, such as polyurethane, or a silicone. The outer layer may be GRIPPE PU, which is a synthetic leather backing covered with a layer of polyurethane (PU) that is applied to the surface and then embossed. When there are two layers, the outer layer may comprise a synthetic leather with a polyurethane coating, such as GRIPPE PU, and have a thickness in the range of about 1.2 mm to about 1.8 mm, or about 1.4 mm to about 1.5 mm, and the inner layer may comprise a synthetic suede and have a thickness in the range of about 0.2 to about 0.8 mm, or about 0.4 to about 0.5 mm.

Filler Material

Whereas regulation softballs, baseballs and sliothars are hard, the sports training balls of the present invention are considerably softer and more compressible. A regulation baseball has a core of a small ball of cork encased in two thin layers of rubber, and optionally wool yarn, while sliothars generally have a cork core, and softballs have centers generally composed of polyurethane, and/or a cork center.

The filler of the sports training balls disclosed herein is a composite filler that is not vulcanized or heated to make a solid core. The entirety of the ball may be filled with the composite filler. The filler may be devoid of cork or kapok. The ball may be devoid of a solid center core, e.g. cork or other material.

Alternatively, the ball may have a solid center core surrounded by the filler inside the outer shell.

The filler of the inventive balls may include a mixture of a first material, a second material, and a third material. The filler substantially occupies the interior volume of the ball's shell. The first material may have a different density than the second material and the third material. The second material may have a different density than the third material. Each material may be selected from sand, comminuted polymer particles, comminuted rubber particles, comminuted stone, birdseed, millet, rice, wood particles (e.g., dry wood dust), beads, beads, feathers, gravel, and fine powder from stone or polymer. Additionally, in some embodiments, the filler may include a fourth material, such as other particulates or additives to the aforementioned fillers.

In an embodiment, the sports training ball comprises a filler wherein the first material is sand and the second material is dry wood dust. In an embodiment, the sports training ball comprises a filler wherein the first material is sand, the second material is dry wood dust, and the third material is rubber particles. The rubber particles may be, optionally recycled, sifted and ground comminuted rubber (elastomer) particles.

Useful sand fillers include medium to fine grade sand which according to the Wentworth Scale have an average diameter of about 0.125 mm to about 1.0 mm, or about 0.125 mm to about 0.5 mm. The particle size is based on the Wentworth scale for particle measurement.

TABLE 1

Wentworth Scale for Measurement of Particles and Grain

| φ scale | Size range (metric) | Size range (inches) | Aggregate name (Wentworth class) | Other names |
|---|---|---|---|---|
| <−8 | >256 mm | >10.1 in | Boulder | |
| −6 to −8 | 64-256 mm | 2.5-10.1 in | Cobble | |
| −5 to −6 | 32-64 mm | 1.26-2.5 in | Very coarse gravel | Pebble |
| −4 to −5 | 16-32 mm | 0.63-1.26 in | Coarse gravel | Pebble |
| −3 to −4 | 8-16 mm | 0.31-0.63 in | Medium gravel | Pebble |
| −2 to −3 | 4-8 mm | 0.157-0.31 in | Fine gravel | Pebble |
| −1 to −2 | 2-4 mm | 0.079-0.157 in | Very fine gravel | Granule |
| 0 to −1 | 1-2 mm | 0.039-0.079 in | Very coarse sand | |
| 1 to 0 | 0.5-1 mm | 0.020-0.039 in | Coarse sand | |
| 2 to 1 | 0.25-0.5 mm | 0.010-0.020 in | Medium sand | |
| 3 to 2 | 125-250 μm | 0.0049-0.010 in | Fine sand | |
| 4 to 3 | 62.5-125 μm | 0.0025-0.0049 in | Very fine sand | |
| 8 to 4 | 3.9-62.5 μm | 0.00015-0.0025 in | Silt | Mud |
| 10 to 8 | 0.98-3.9 μm | $3.8 \times 10^{-5}$-0.00015 in | Clay | Mud |
| 20 to 10 | 0.95-977 nm | $3.8\times10^{-8}$-$3.8 \times 10^{-5}$ in | Colloid | Mud |

Average particle sizes (diameters) of comminuted rubber particles or other elastomeric fillers are generally in the range of about 0.0625 mm ("very fine sand") to about 2.00 mm ("granule").

Average particle sizes (diameters) of comminuted stone particles or other solid fillers are generally in the range of about 0.0625 mm ("very fine sand") to about 2.00 mm ("granule"), or about 0.0625 mm ("very fine sand") to about 1.00 mm ("coarse sand").

The relative amounts of the three filler materials is also important because, in certain embodiments, the sports training ball is intended to meet the size and weight of a regulation ball, but be softer, more compressible and maintain impact absorption so that it hurts less on the body than a regulation ball. Desirably, when the filler contains three materials, they are substantially uniformly mixed together and loaded into the interior volume of the outer shell.

The sports training ball may comprise a filler of sand, wood, and birdseed. The sports training ball may comprise a filler of sand, dry wood dust, and rubber particles. When the sports training ball comprises a filler of sand, dry wood dust, and rubber particles, over half the weight of the ball may be from the weight of the sand. When the sports training ball comprises a filler of sand, dry wood dust, and rubber particles, less than one-quarter the weight of the ball may be from the weight of the dry wood dust.

When sand is used as a filler, the amount of sand may generally range from about 50 g to about 120 g of sand, or about 60 g to about 107 g. For a regulation baseball training ball, the amount of sand may range from about 60 g to about 80 g of sand, about 65 g to about 75 g, or from about 70 g to about 80 g.

When rubber is used as a filler, the amount of comminuted rubber (elastomer) may be in the range of about 20 g to about 80 g, or about 25 g to about 70 g. For a regulation baseball training ball, the amount of comminuted rubber (elastomer) may be in the range of about 15 g to about 60 g, about 20 g to about 50 g, or about 25 g to about 40 g. In some embodiments, sand may be combined with comminuted rubber (elastomer) and/or comminuted stone, for example, about 25 g to about 70 g of rubber and about 60 g to about 80 g of comminuted stone or sand.

When the sports training ball is a regulation-size baseball, the filler may comprise sand, wood, and birdseed. When the sports training ball is a regulation-size baseball, the filler may comprise sand, dry wood dust, and rubber particles. The baseball training ball may contain about 65 to about 75 grams of sand, about 25 g to about 35 g rubber, and about 15 g to about 25 g dry wood dust. The baseball training ball may contain about 70 grams of sand, about 30 g rubber, and about 20 g dry wood dust. The shell of the baseball training ball may weigh about 20 g to about 28 g, or about 25 g or about 26 grams.

When the sports training ball is a heavy baseball, the filler may comprise sand, wood, and birdseed, or the filler may comprise sand, dry wood dust, and rubber particles. The heavy baseball training ball may contain about 75 to about 300 grams of sand, about 30 g to about 55 g rubber, and about 20 g to about 35 g dry wood dust. The shell of the heavy baseball training ball may weigh about 20 g to about 28 g, or about 25 grams.

When the sports training ball is a lite baseball, the filler may comprise sand, wood, and birdseed, or the filler may comprise sand, dry wood dust, and rubber particles. The lite baseball training ball may contain about 25 to about 65 grams of sand, about 20 g to about 28 g rubber, and about 12 g to about 20 g dry wood dust. The lite baseball training ball may contain about 59 grams of sand, about 24 g rubber, and about 16 g dry wood dust. The shell of the lite baseball training ball may weigh about 20 g to about 28 g, or about 25 grams.

When the sports training ball is a regulation-size softball and the filler comprises sand, dry wood dust, and rubber particles, the ball may contain about 80 to about 100 grams of sand, about 30 g to about 50 g rubber, and about 20 g to about 40 g dry wood dust. The softball training ball may contain about 90 grams of sand, about 40 g rubber, and about 30 g dry wood dust. The shell of the softball training ball may weigh about 30 g to about 38 g, or about 33 grams.

When the sports training ball is a regulation-size sliotar and the filler comprises sand, dry wood dust, and rubber particles, the ball may contain about 45 to about 65 grams of sand, about 15 g to about 35 g rubber, and about 10 g to about 25 g dry wood dust. The sliotar training ball may contain about 55 grams of sand, about 24 g rubber, and about 16 g dry wood dust. The shell of the sliotar training ball may weigh about 17 g to about 23 g, or about 20 grams.

For certain embodiments, such filler mixtures for an inventive training baseball being about the size and weight of a regulation baseball include a mixture of sand, dry wood dust, and rubber to create filler that has a total mass in the range of about 110 grams to about 130 grams, about 115 grams to about 125 grams, or about 120 grams. For other embodiments, the mixture of sand, dry wood dust, and rubber may be varied to create filler that has a total mass in the range of about 100 grams to about 115 grams ("light ball") or about 125 grams to about 150 grams ("heavy ball"). Much work, experiments and tests was put in to select the right combination of filler and determine the correct ratio to meet the exact dimensions of the regulation baseball.

For certain embodiments, such filler mixtures for an inventive training softball being about the size and weight of a regulation softball include a mixture of sand, dry wood dust, and rubber to create filler that has a total mass in the range of about 170 grams to about 205 grams, about 178 grams to about 198 grams. For other embodiments, the mixture of sand, dry wood dust, and rubber may be varied to create filler that has a total mass in the range of about 100 grams to about 165 grams ("light ball") or about 205 grams to about 275 grams ("heavy ball"). Much work, experiments and tests was put in to select the right combination of filler and determine the correct ratio to meet the exact dimensions of the regulation softball.

For certain embodiments, such filler mixtures for an inventive training sliothar being about the size and weight of a regulation sliothar include a mixture of sand, dry wood dust, and rubber to create filler that has a total mass in the range of about 100 grams to about 130 grams, about 110 grams to about 120 grams. For other embodiments, the mixture of sand, dry wood dust, and rubber may be varied to create filler that has a total mass in the range of about 80 grams to about 95 grams ("light ball") or about 125 grams to about 150 grams ("heavy ball"). Much work, experiments and tests was put in to select the right combination of filler and determine the correct ratio to meet the exact dimensions of the regulation sliotar.

When the sports training ball is a regulation-size golf ball and the filler comprises sand and rubber particles, and optionally dry wood dust, the ball may contain about 12 to about 20 grams of sand, about 18 g to about 30 g rubber, and optionally, about 0.5 g to about 5 g dry wood dust. The shell of the golf training ball may weigh about 5 g to about 10 g, or about 8 grams.

A filler mixture may be introduced to the interior volume of a shell of the ball by combining the filler materials and pouring the combination into the interior volume with a funnel until the appropriate mass of material has been filled into the interior volume.

In another embodiment, the inventive training ball may be substantially the same size as the regulation sports ball but heavier, referred to herein as a "heavy ball." The heavy ball may have an average weight about 12% to about 18% heavier, or preferably about 15% heavier, than the regulation sports ball.

In another embodiment, the inventive training ball may be substantially the same size as the regulation sports ball but lighter, referred to herein as a "lite ball." The light ball may have an average weight about 12% to about 18% lighter, or preferably about 15% lighter, than the regulation sports ball.

In an embodiment, a sports training ball made in accordance with this disclosure compresses to about 25% of its diameter between two platens under about 55 lbs to about 100 lbs (compression load), about 60 lbs to about 95 lbs, or about 70 lbs to about 95 lbs. Because the inventive ball is more easily compressed (with less load), the point of impact when a ball hits a target (such as a player) is diffused, suggesting potentially safer play with less potential for injury.

Stitching

The balls made in accordance with the present invention may be stitched together using a multiply thread. The balls are preferably hand-stitched. A thread of any ply known in the art may be used. For example, a 1-ply, 2-ply, 3-ply, 4-ply, 5-ply, 8-ply, 10-ply, 12-ply, 16-ply thread may be used. In an embodiment, a 12-ply, No. 12 Beeswax thread is used. Threads may be from natural fibers or synthetic fibers, such as polyester fibers or nylon.

The inventive sports training balls may have 3-30, 15-30, 20-25 or 22-24 knots. The inventive sports training balls may have 20, 21, 22, 23, 24, 25, or 26 knots. On a twelve panel dodecahedron construction, the inventive sports training balls may have 22-24 knots. Without the proper number of knots, the long thread will become overly flexible and the resulting ball with be deformed, e.g., in a D shape, or the corners will be not be tightly connected. Knots may be placed with one in each or after each corner. There may be a knot to tie running thread properly and then cut the thread after each knot. There may be a knot from next starting point. Smaller balls have fewer stitches on each side of panel, but with the same number of knots.

The balls made in accordance with the present invention may be single stitched, double stitched, triple stitched, quadruple stitched or greater, depending on the type of sports ball being made. For example, baseball training balls made may have single stitching, double stitching or triple stitching or higher. When the ball is designed for higher throwing and speeds, the level of stitching may concomitantly be higher as well to prevent the ball from breaking and releasing the filling. The stitching is generally designed not to break before the outer shell breaks in both testing and use.

In an embodiment, baseball training balls made in accordance with this disclosure do not break when thrown 10 or more consecutive times against metal plates at speeds up to 70 MPH, about 50-about 70 mph, or about 55-about 70 MPH. Baseball training balls made in accordance with this disclosure do not break when thrown 20, 30 or 40 times against metal plates at speeds up to 70 MPH, about 50-about 70 mph, or about 55-about 70 MPH. In another embodiment, baseball training balls made in accordance with this disclosure do not break when thrown 10 or more consecutive times against walls of brick or concrete at speeds up to 70 MPH, about 50-about 70 mph, or about 55-about 70 MPH. Baseball training balls made in accordance with this disclosure do not break when thrown 20, 30 or 40 times against walls of brick or concrete at speeds up to 70 MPH, about 50-about 70 mph, or about 55-about 70 MPH. The ball does "not break" means that the seams do not break or rip and no filler is released. It also may be phrased as remaining intact. This is in contrast to stitched balls in the prior art made from synthetic rubbers and containing plastic pellets or beads and which break when tested at such speeds, leaking filler material.

Embossing

The method of embossing the sports training ball of the present disclosure may be performed according to the following steps: (a) selecting a shell fabric; (b) cutting the shell fabric to a desired shape and size; (c) embossing a design on the cut shell fabric; (d) stitching the cut shell fabric into a ball exterior leaving one or more open seams; (e) filling the stitched ball exterior. Embossing is performed on the flattened fabric. Embossing of the shell fabric of the sports training ball may be performed by any means known in the art for embossing fabrics. Embossing may be performed using molds and a heat press machine. The embossing mold for each panel of the ball may be different from each or the others. The molds are made in the same pattern in which printing is done. The mold is placed on the printed design on the shell fabric and is pressed with force and heat with press machine to create a raised surface.

The step of embossing may include: printing, pressing, molding, carving, and any combination thereof to apply the design to the shell fabric. Embossing may result in the design having a raised, depressed or sticky feel to the touch.

The printing and molding may be in the design, and optionally the color, of the stitching and lacing on a regulation MLB baseball, as shown in FIG. 1, where the embossed lacing design is red and the shell is white.

Adhesives

When multiple layers are used to construct the outer shell, they may be joined by laminating the layers using various methods, including adhesive, hot melting the layers together, or by mechanical devices such as stitching. Desirably the layers are joined by adhesive lamination. The joined layers should substantially retain the flexibility of each layers, and not separate on impact, such as when caught at high speeds, or when tested for COR (Coefficient of Restitution).

Useful adhesives include those that have a degree of flexibility when cured, such as natural latex adhesives or synthetic rubber adhesives. One useful brand of adhesive is sold under the Kangaroo brand name, for example Kangaroo 505. Synthetic adhesives, such as SBR rubbers may also be used. A lamination may be processed using pure latex and 150 grams PV fabric.

Hot melt adhesives may also be used to laminate the layers, for example, those adhesives made from ethylene-vinyl acetate (EVA), optionally with additives therein, such as wax and/or resin.

In addition to lamination of shell layers, adhesives may also be applied to the knots used to tie-off the stitches, to prevent potential loosing.

An embodiment is a sports training ball, for example a lacrosse ball, comprising an outer shell layer comprising a plurality of sections connected along a plurality of seams, the sections having an outer surface comprising an outer layer of a smooth non-woven synthetic leather (which optionally may be patterned and/or textured) with a polymer or silicone coating thereon, the outer layer is laminated on the side without the coating to an under layer of a non-woven synthetic suede or velour. Lamination may be achieved using an adhesive such as a hot melt adhesive, for example, EVA (ethylene vinyl-acetate) glue. The sports training ball may optionally be of the regulation size and weight for a ball of that sport. It also may be manufactured to be regulation size but of a greater weight than approved for the regulation ball of that sport. The outer surface may weigh about 15 g to about 25 g, or about 20 g. The filler may comprise a mixture of refined sand, and comminuted rubber, and optionally a third material, such as wood, birdseed or other particulate.

Figure 2:
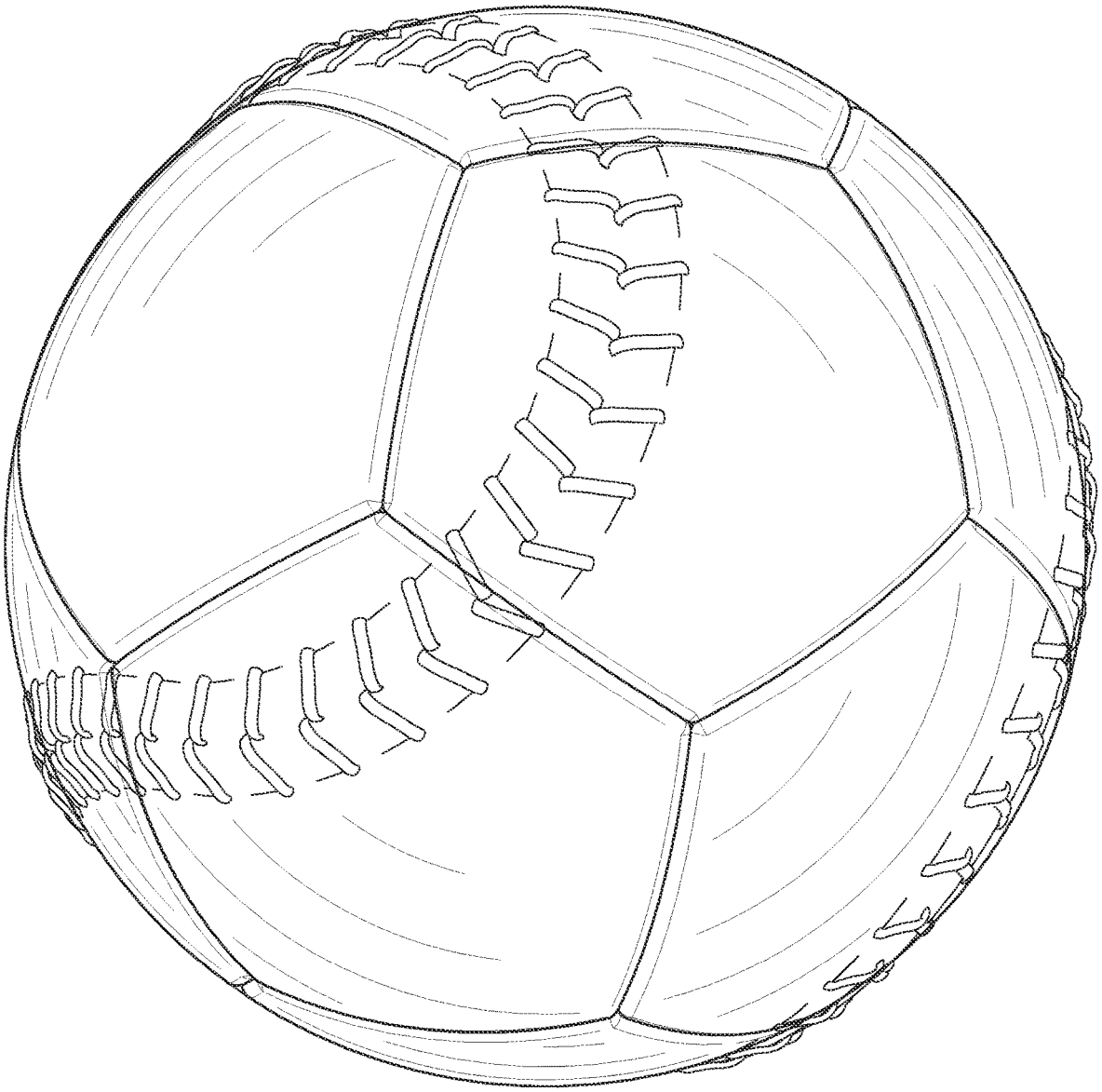
FIG. 2 is an isometric bottom view of the sports training ball shown in FIG. 1.

Referring now to the drawings wherein aspects of the subject application are shown, FIGS. 1 and 2 are various views of a sports ball 100 in accordance with an embodiment of the present disclosure. FIG. 1 shows an exterior of the sports ball and FIG. 2 shows a cross-sectional view of the sports ball. The sports ball illustrated in FIGS. 1 and 2 has an outer surface made up of twelve shell sections each of which has a pentagonal shape. Sections 102*a*-102*h* making up the cover of the sports ball are visible in FIGS. 1 and 2. Note that there are four additional pads that are not visible in FIGS. 1 and 2 because they are on the opposite side of the sports ball from the perspective shown. It will be understood by a skilled practitioner that other numbers of sections or shapes of sections may be used in the design of other embodiments of sports balls in accordance with the present disclosure.

As indicated in FIGS. 1 and 2 the twelve shell sections are connected by a plurality of seams that are sewn with a thread. As indicated in FIG. 1, there is a single seam 104*a*-104*e* that connects pad 102*g* on each of its five sides to its five neighboring (or adjacent) sections 102*a*, 102*b*, 102*h*, 102*e*, and 102*f*. A completed twelve-sided (that is, twelve sections) ball with pentagonal sections has a total of 12 seams connecting sections together. In an embodiment, the seams are sewn with thread such as bees waxed nylon thread or polyester thread. In an embodiment, multi-ply (e.g., 3-ply, 4-ply, or 5-ply) nylon thread may be used. In another embodiment, double-stitching is used resulting in still stronger tension (e.g., 12-ply). Also indicated in FIG. 1 is a hole 106 through which the needle passes when a finishing knot is positioned inside the ball.

Figure 3:
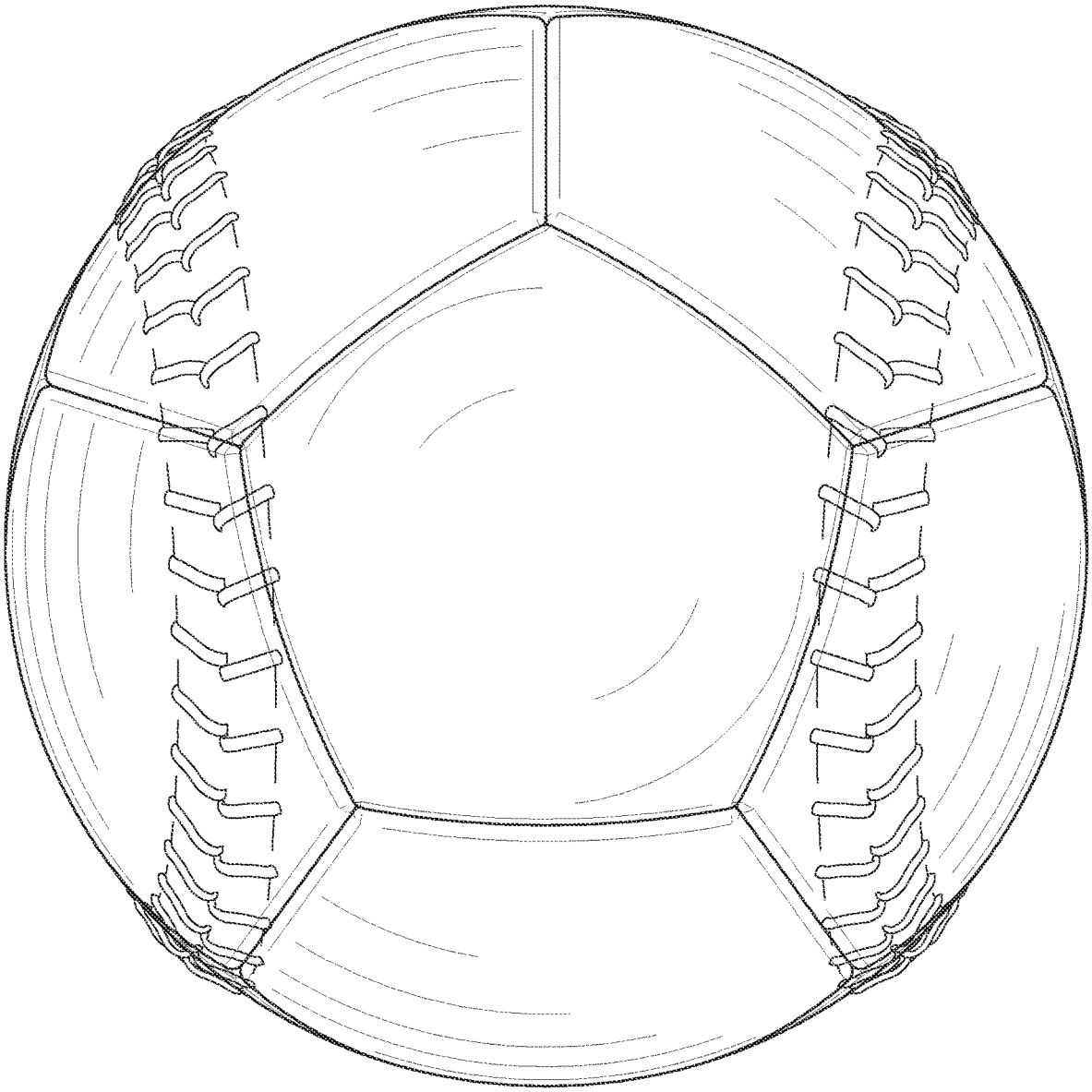
FIG. 3 is a front plan view of the sports training ball shown in FIG. 1.
Figure 4:
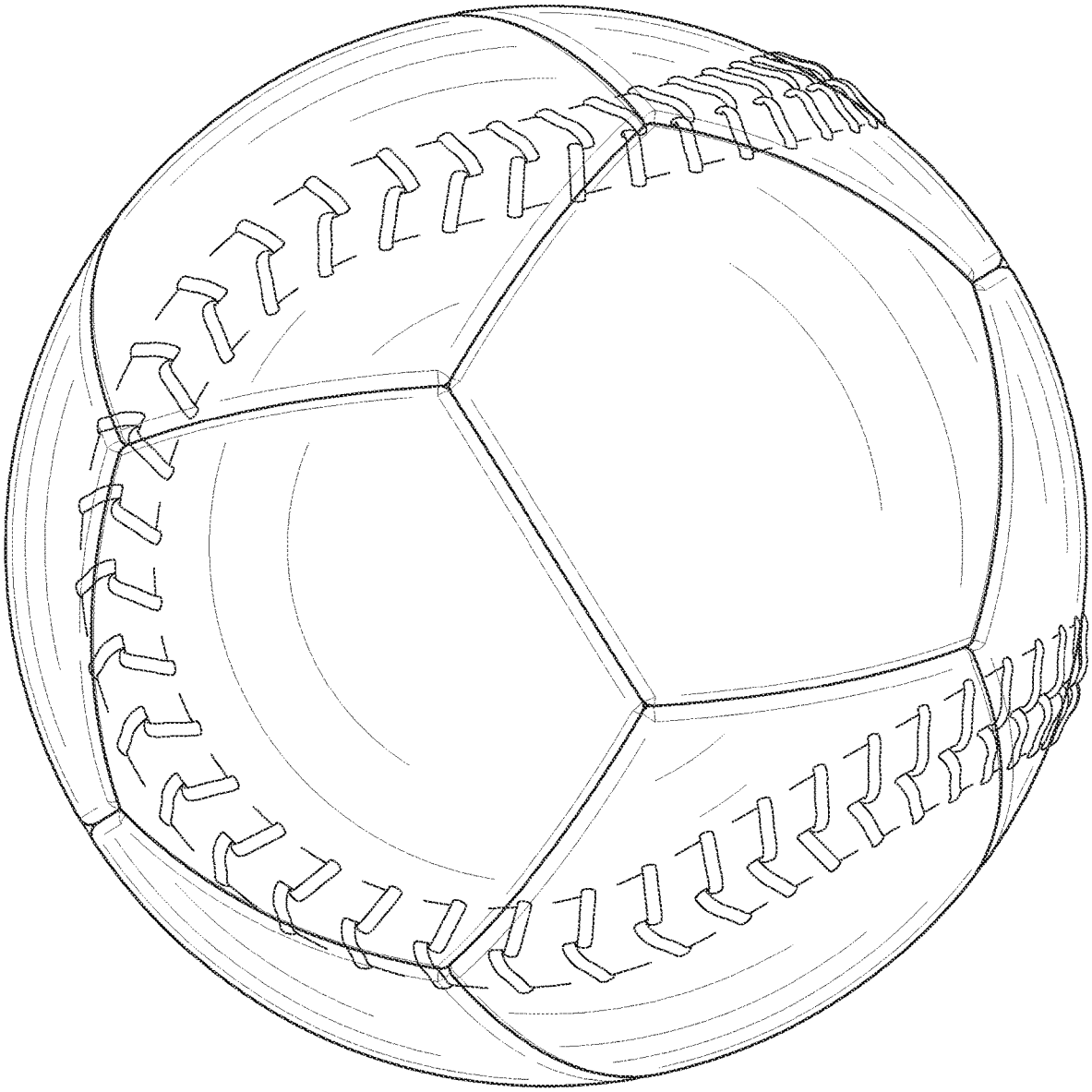
FIG. 4 is a right side view of the sports training ball shown in FIG. 1.
Figure 5:
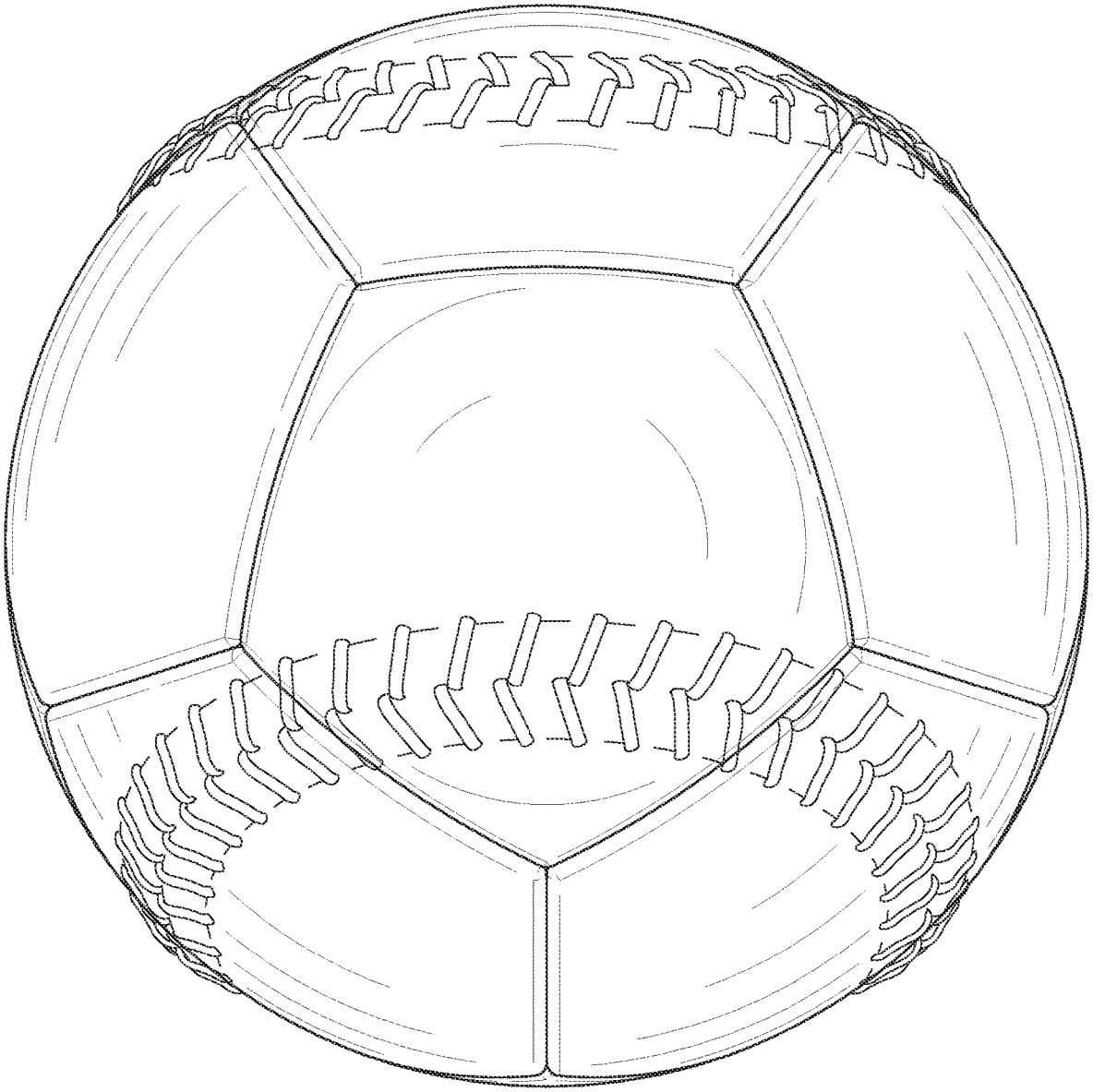
FIG. 5 is a rear plan view of the sports training ball shown in FIG. 1.
Figure 6:
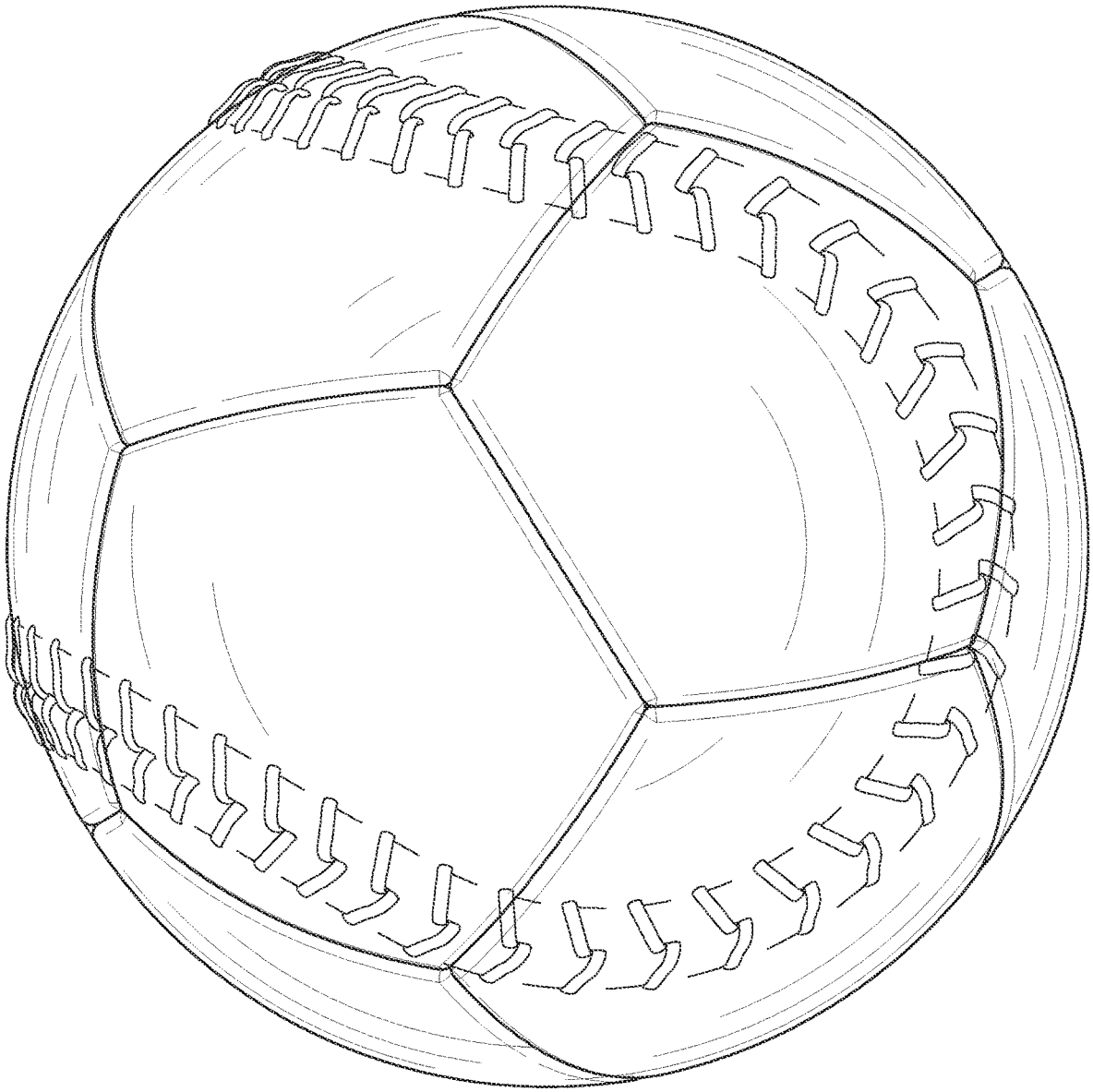
FIG. 6 is a left side view of the sports training ball shown in FIG. 1.
Figure 7:
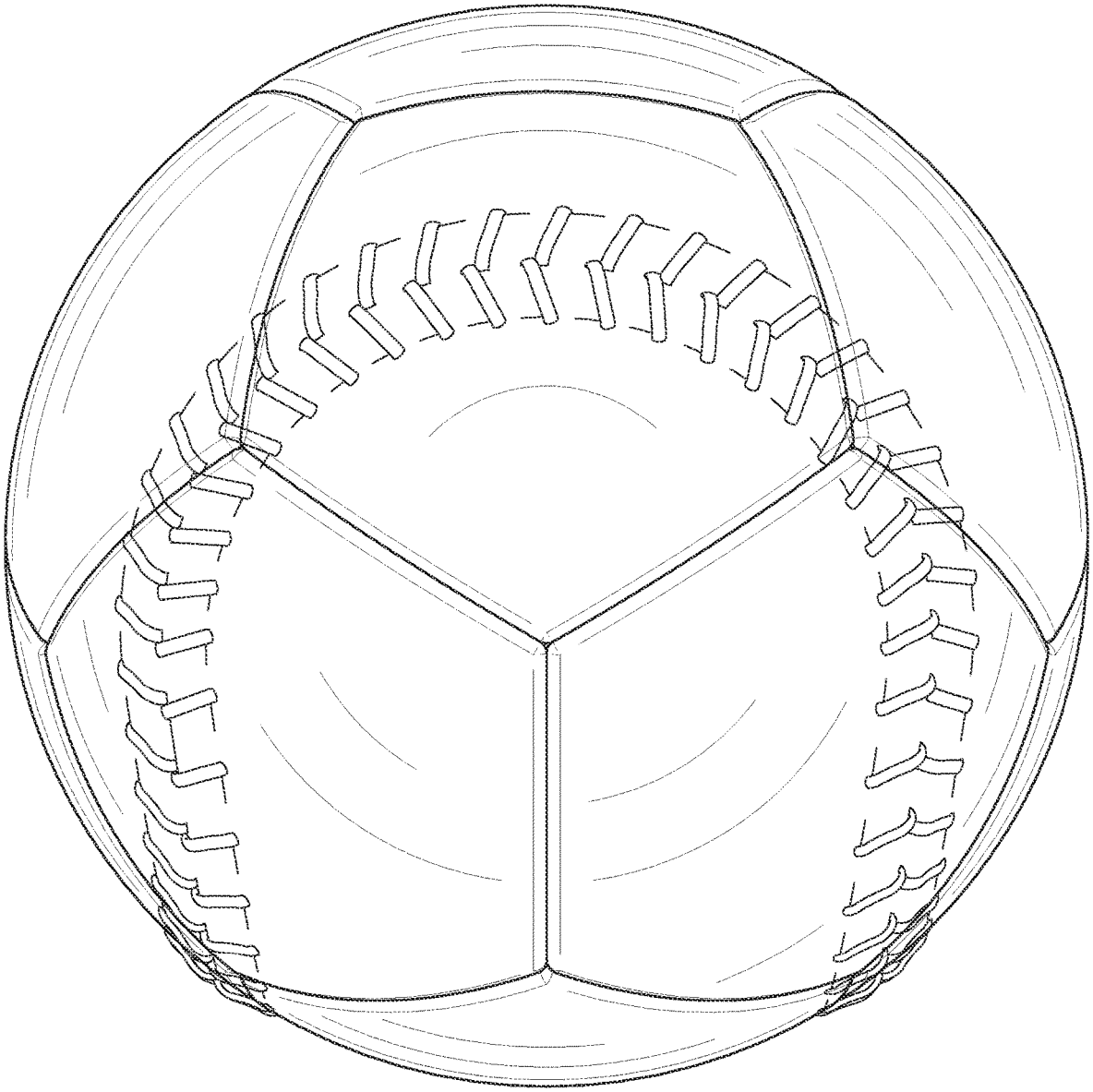
FIG. 7 is a top view of the sports training ball shown in FIG. 1.
Figure 8:
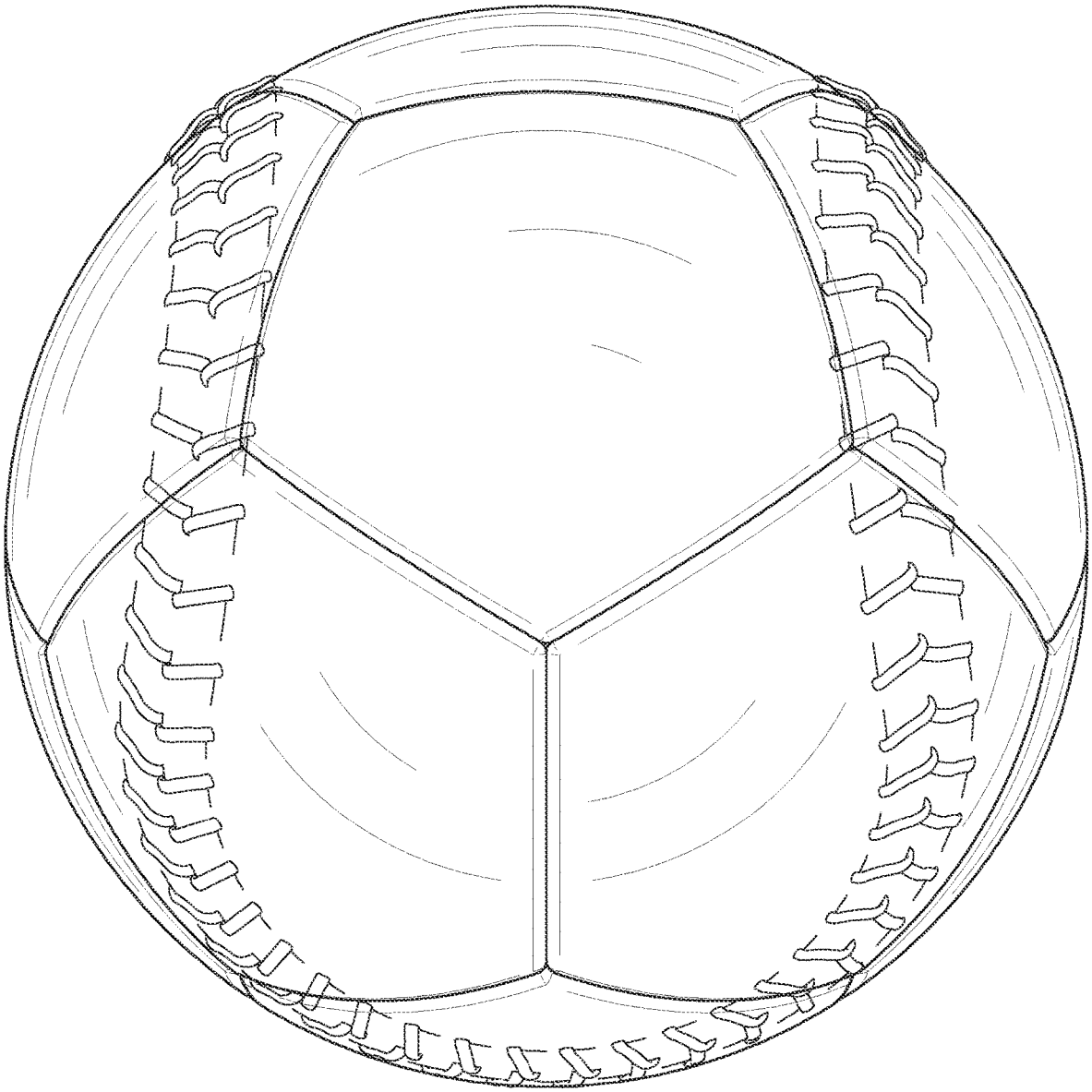
FIG. 8 is a bottom view of the of the sports training ball shown in FIG. 1.
Figure 9:
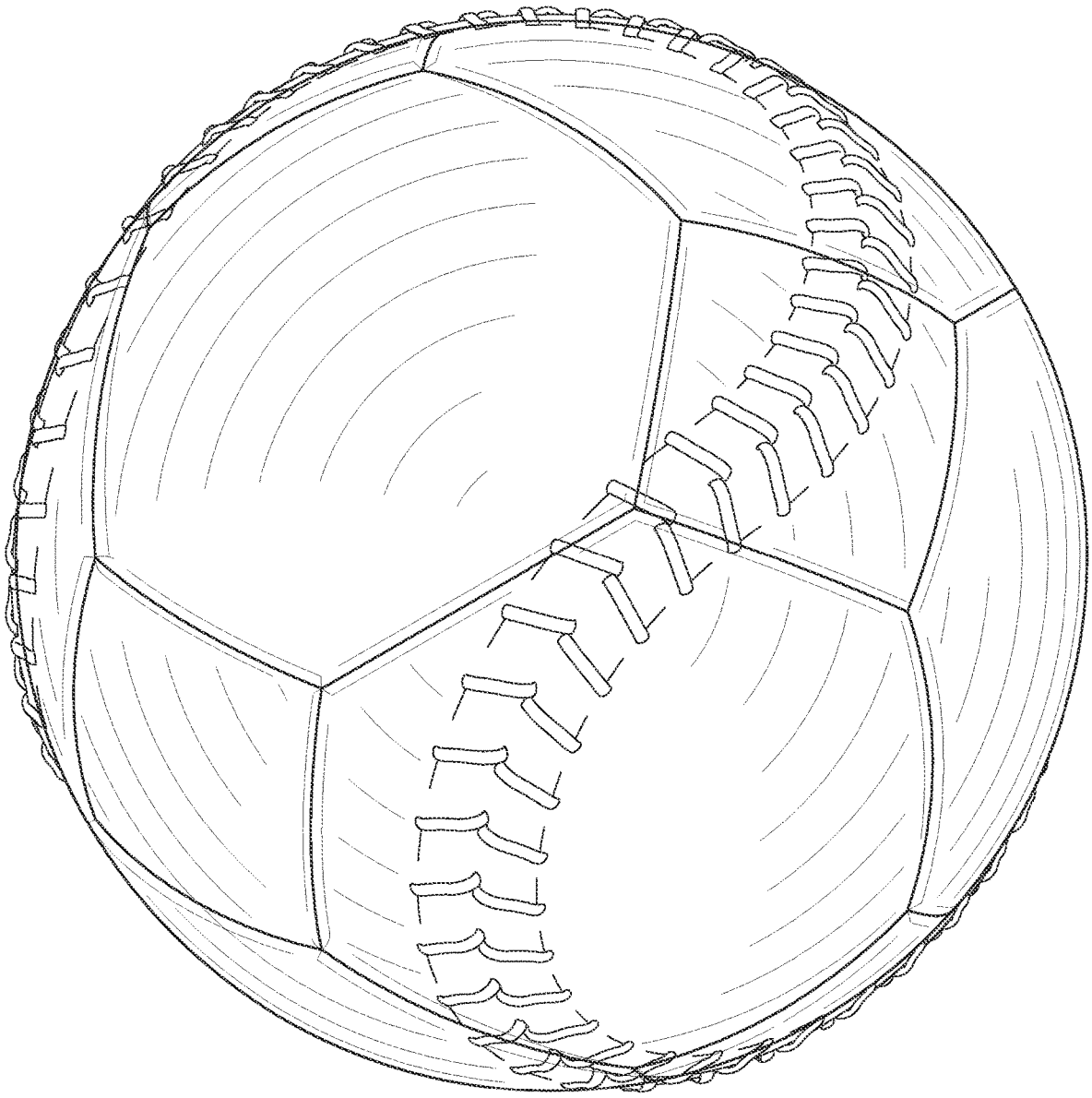
FIG. 9 is an isometric top view of a sports training ball of the disclosure having square and hexagonal pads and embossed lacing.
Figure 10:
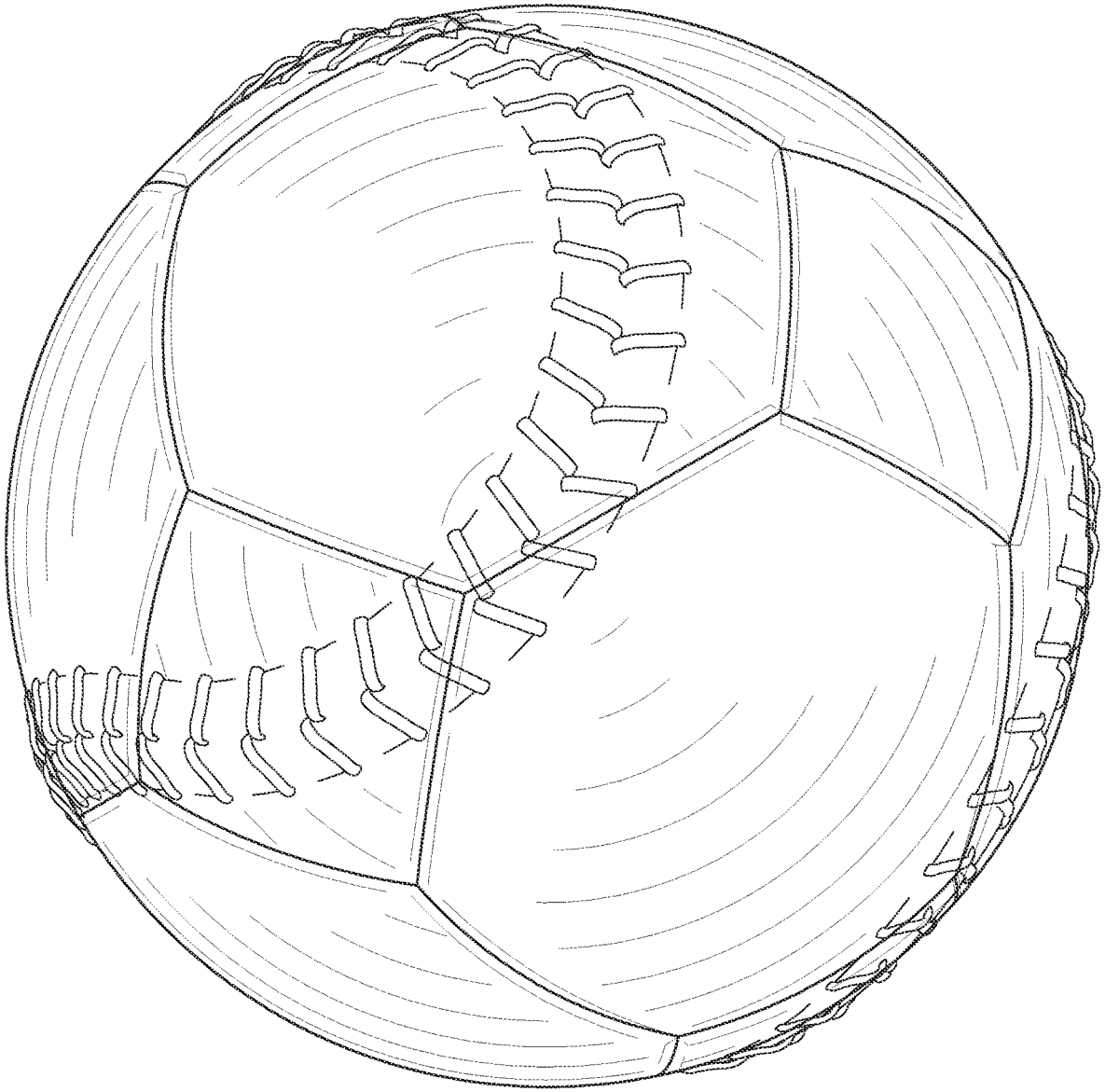
FIG. 10 is an isometric bottom view of the sports training ball shown in FIG. 9.
Figure 11:
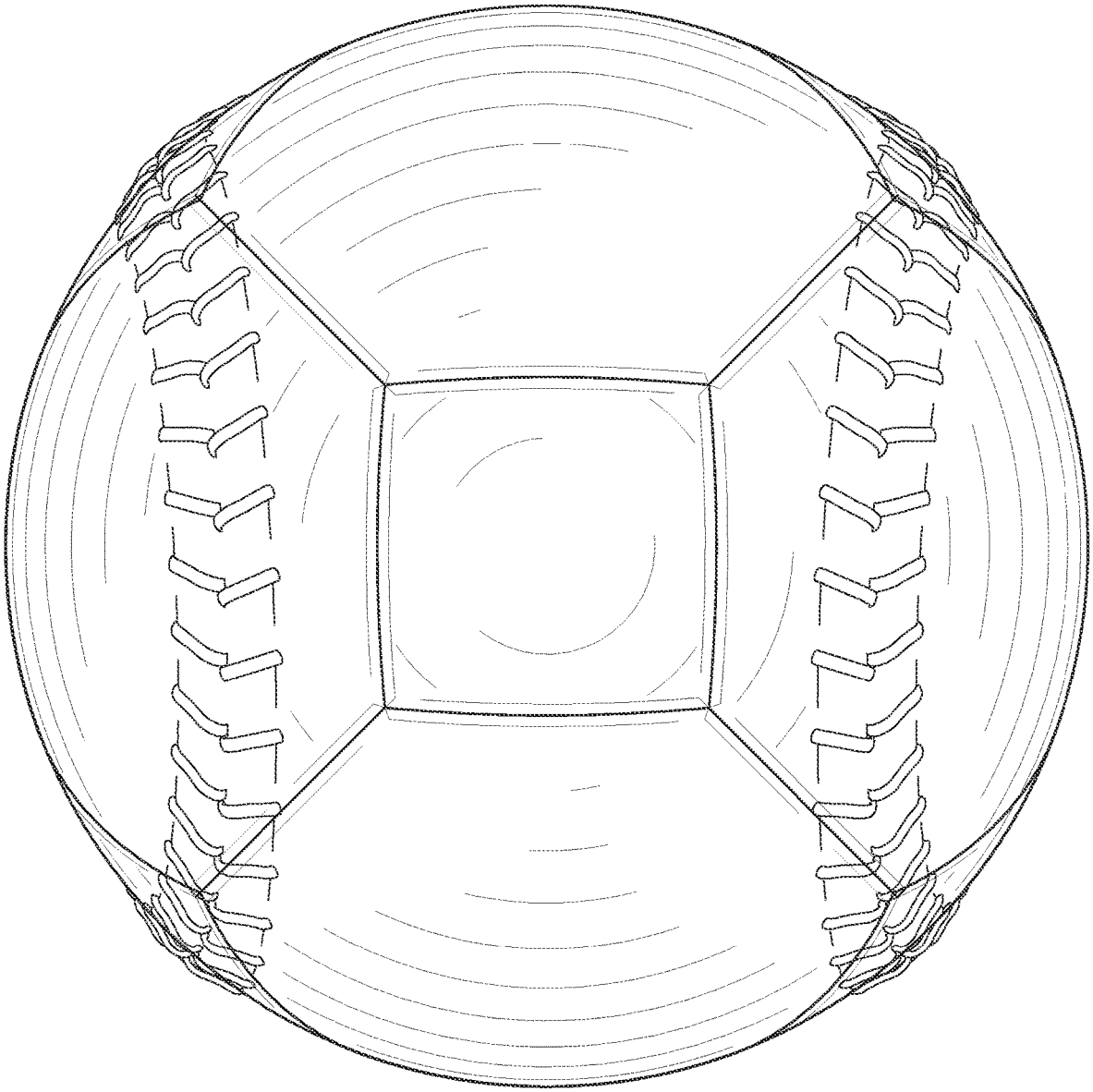
FIG. 11 is a front plan view of the sports training ball shown in FIG. 9.
Figure 12:
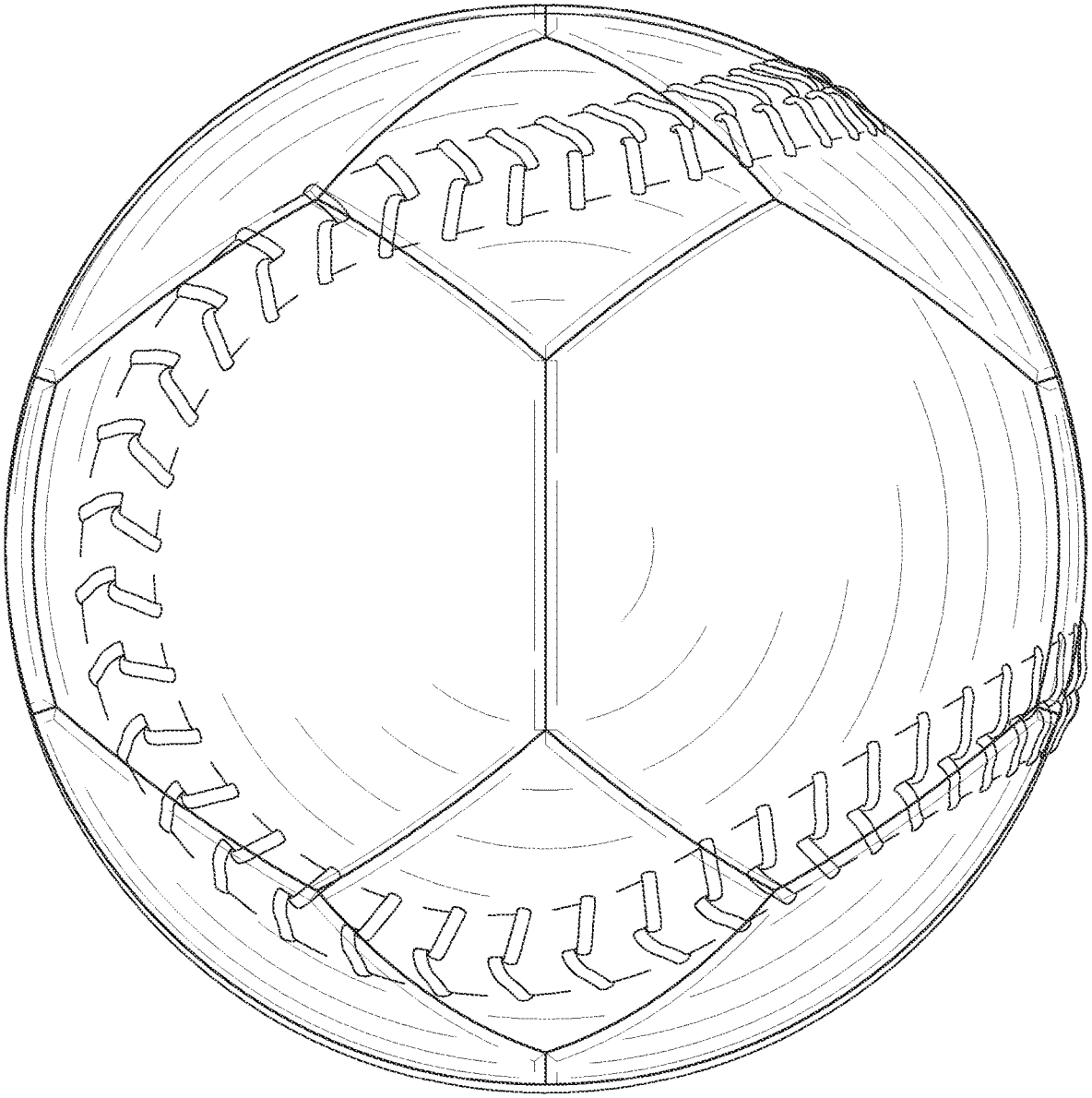
FIG. 12 is a right side view of the sports training ball shown in FIG. 9.
Figure 13:
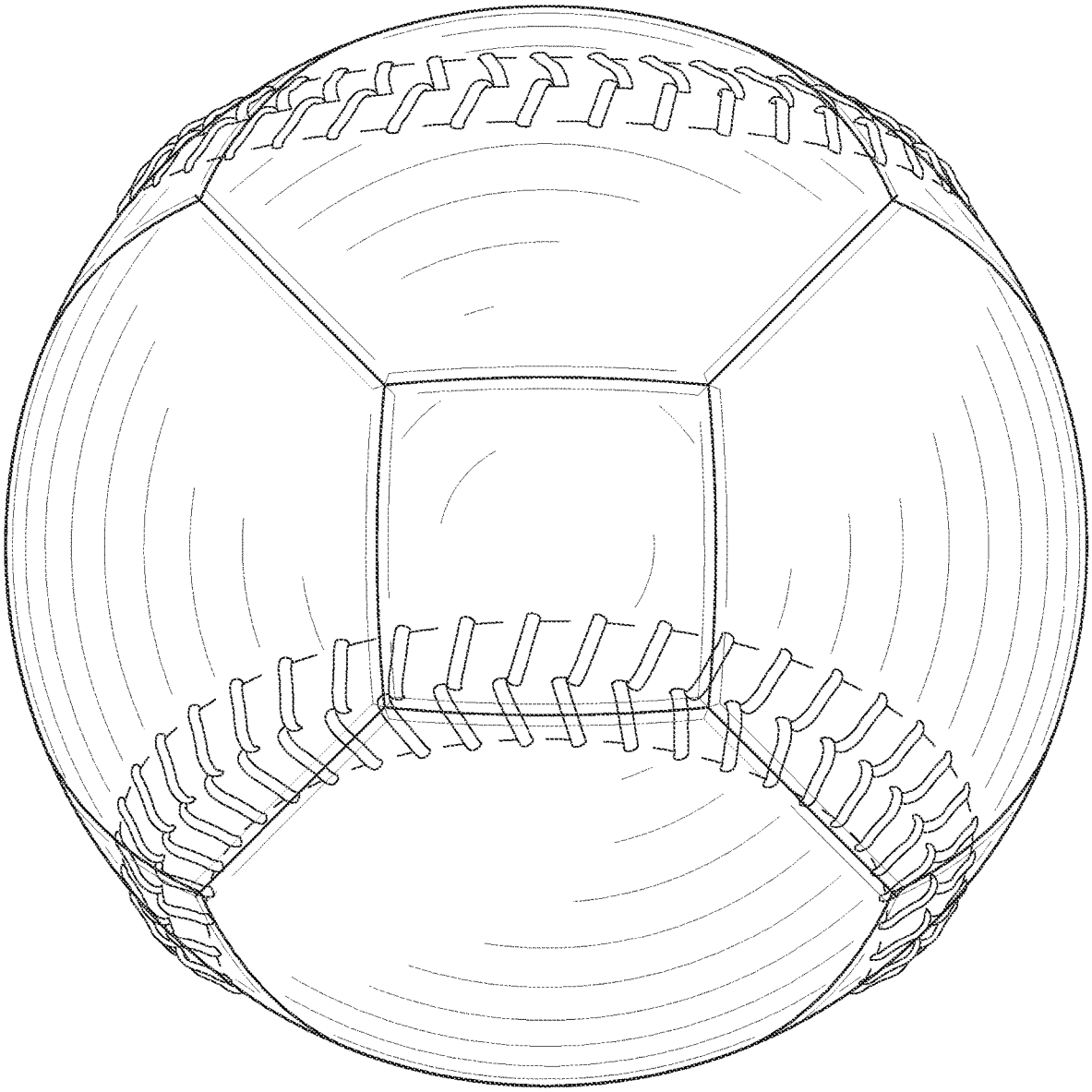
FIG. 13 is a rear plan view of the sports training ball shown in FIG. 9.
Figure 14:
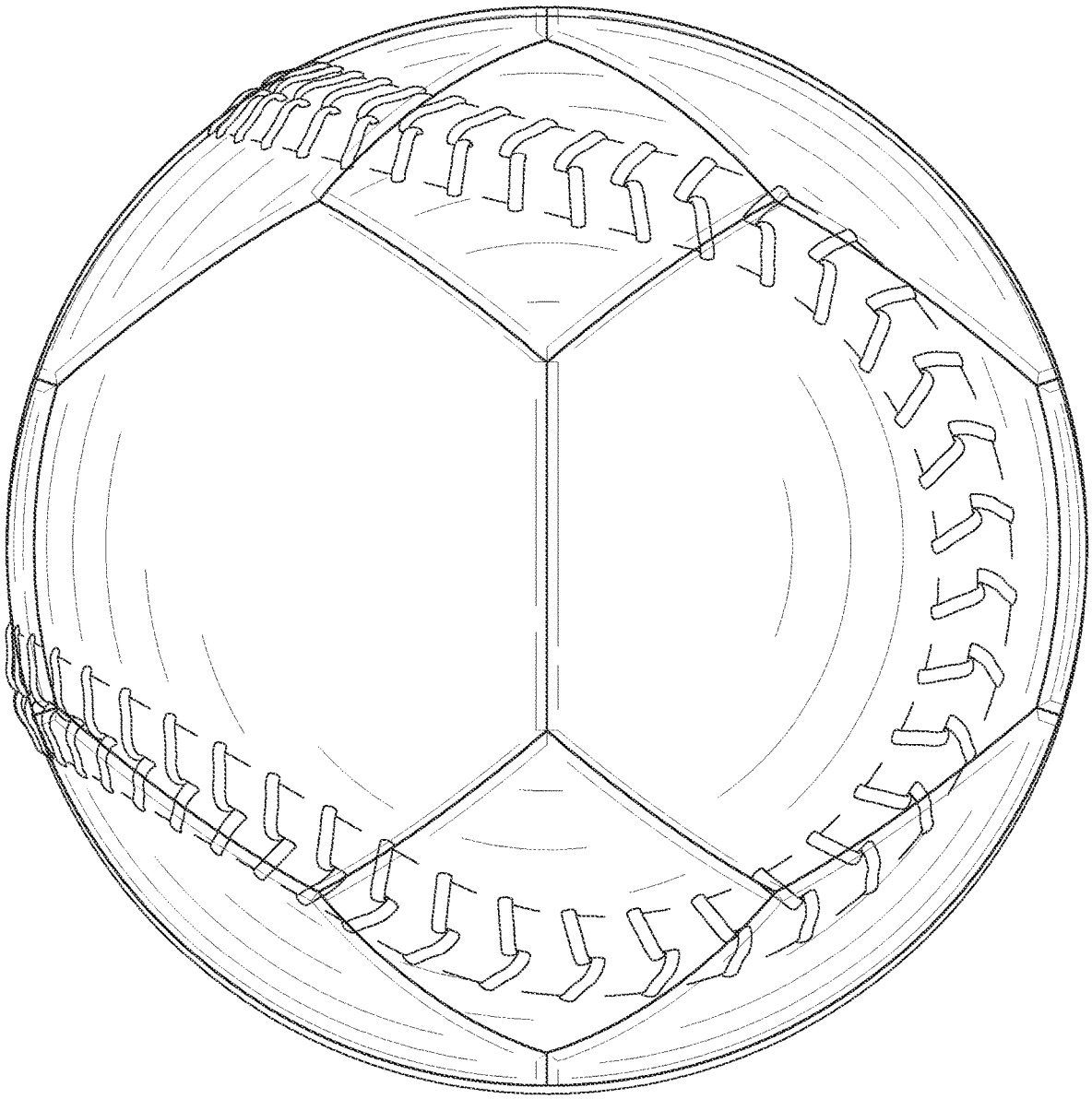
FIG. 14 is a left side view of the sports training ball shown in FIG. 9.
Figure 15:
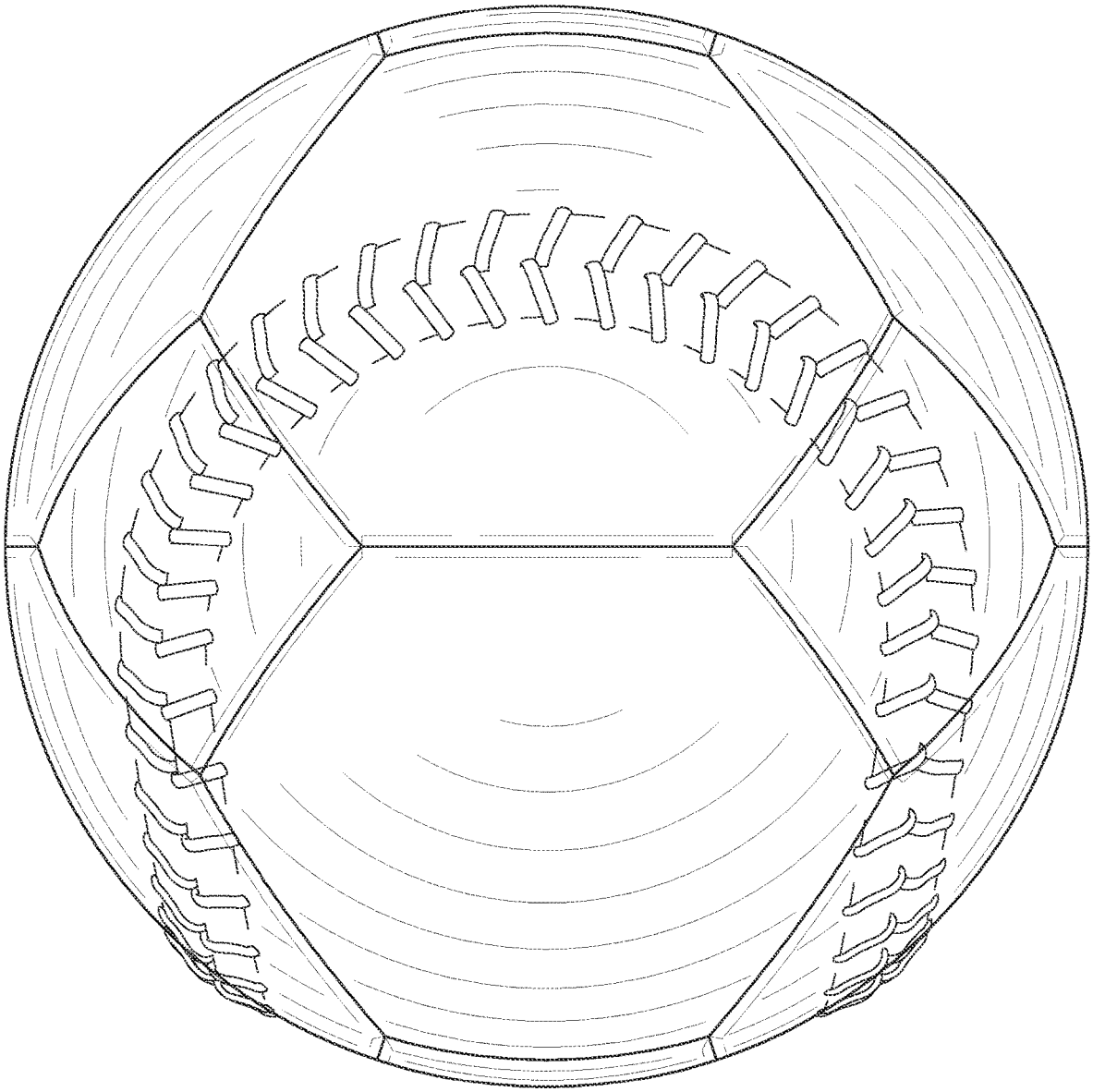
FIG. 15 is a top view of the sports training ball shown in FIG. 9.
Figure 16:
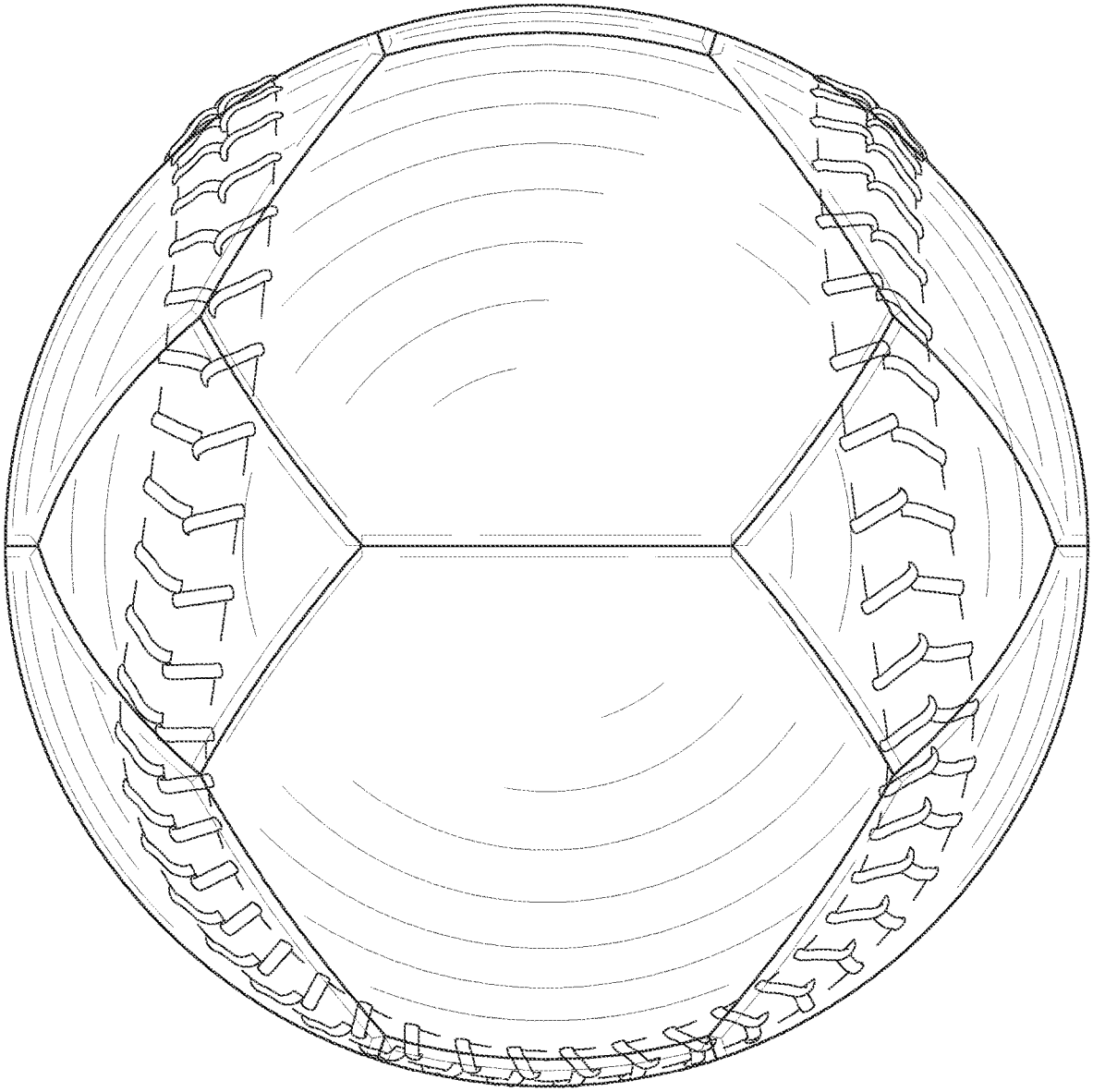
FIG. 16 is a bottom view of the sports training ball shown in FIG. 9.

FIG. 3 is a cross-sectional view of the ball illustrated in FIG. 1 showing additional layer 112 laminated to the shell sections. As further described herein, the outer shell may be joined with one or more additional layers to provide strength or impart other properties to the ball. Desirably, a flexible adhesive (not shown), such a natural or synthetic latex adhesive, is used to join the layers, although other methods such as heat, sewing or the like may be employed. The additional layers may serve to prevent leakage of the fine filler material when the ball is struck against hard surfaces. As further described herein, the additional layers may be selected from a variety of materials including non-woven polymeric materials such artificial leather materials, and in particular non-woven artificial suede, as well as natural and synthetic woven textile materials, such as cotton or polyester fabrics. The filler material 108 in this embodiment as well as other embodiments, typically 108 includes three different density materials as further described herein.

The terms used in connection with this embodiment have the same meanings as described above.

The above-described aspects are merely possible examples of implementations, set forth for a clear understanding of the principles of the present disclosure. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure.

While there have been described what are presently believed to be the certain desirable embodiments of the invention, those skilled in the art will realize that changes and modifications may be made thereto without departing from the spirit of the invention, and it is intended to include all such changes and modifications as fall within the true scope of the invention. Moreover, although specific terms are employed herein, as well as in the claims that follow, they are used only in a generic and descriptive sense, and not for the purposes of limiting the described invention, nor the claims that follow.

What is claimed:

1. A sports training ball comprising:

a shell defining an enclosure having an interior volume, the shell including a plurality of pads connected along a plurality of seams sewn with a thread having a finishing knot; and a composite filler that includes a mixture of a first material, a second material, and a third material comprising dry wood dust, wherein the composite filler substantially occupies the interior volume, wherein the sports training ball has an embossed design on one or more of the pads, wherein the sports training ball is at least one of a baseball, a softball, a golf ball, or a sliothar;

wherein the composite filler forms a compressible core; and wherein:

when the sports training ball is the baseball of regulation weight, the sports training ball contains about 15 g to about 25 g dry wood dust;

when the sports training ball is a softball of regulation weight, the sports training ball contains about 20 g to about 40 g dry wood dust;

when the sports training ball is a golf ball of regulation weight, the sports training ball contains about 0.5 g to about 5 g dry wood dust; and when the sports training ball is a sliothar of regulation weight, the sports training ball contains about 10 g to about 25 g dry wood dust.

2. The sports training ball of claim 1, wherein the first material is a ground elastic material selected from the group consisting of a polyisoprene, latex, natural rubber, and synthetic rubber.

3. The sports training ball of claim 2, wherein the second material is a plurality of grains of sand.

4. The sports training ball of claim 1, wherein the sports training ball has a weight of about 3 ounces to about 12 ounces.

5. The sports training ball of claim 3, wherein over 50 weight % of the ball is the sand.

6. The sports training ball of claim 1, wherein the shell includes 2-20 pads.

7. The sports training ball of claim 1, wherein the plurality of pads consists of twelve pads and each pad has a pentagonal shape.

8. A baseball training ball comprising:

a shell defining an enclosure having an interior volume, the shell including a plurality of pads connected along a plurality of seams sewn with a thread having a finishing knot; and a composite filler that includes a mixture of a first material, a second material comprising a plurality of grains of sand, and a third material comprising dry wood dust;

wherein the composite filler substantially occupies the interior volume and forms a compressible core, wherein the composite filler includes about 65 grams to about 75 grams of sand, and about 15 grams to about 25 grams of dry wood dust, and wherein the baseball training ball has a weight of about 3 ounces to about 12 ounces and has an embossed lacing design on one or more of the pads.

9. The baseball training ball of claim 8, wherein the first material is a ground elastic material selected from the group consisting of a polyisoprene, latex, natural rubber, and synthetic rubber.

10. The baseball training ball of claim 8, wherein the ball has a weight of about 5 ounces to about 5¼ ounces.

11. The baseball training ball of claim 8, wherein the ball has a circumference of about 8.7 inches to about 9.5 inches.

12. The baseball training ball of claim 8, wherein the embossed lacing provides a player with an indication of proper ball placement when held by the player.

13. The baseball training ball of claim 9, wherein the ball contains about 25 g to about 35 g of rubber.

14. The baseball training ball of claim 8, wherein the plurality of pads consists of twelve pads and each pad has a pentagonal shape.

15. A softball training ball comprising:

a shell defining an enclosure having an interior volume, the shell including a plurality of pads connected along a plurality of seams sewn with a thread having a finishing knot; and a composite filler that includes a mixture of a first material, a second material comprising a plurality of grains of sand, and a third material comprising dry wood dust, wherein the composite filler substantially occupies the interior volume and forms a compressible core, wherein the composite filler includes about 20 grams to about 40 grams of dry wood dust, and wherein the softball has a weight of about 160 grams to about 200 grams and has an embossed lacing design on one or more of the pads.

16. The softball training ball of claim 15, wherein the first material is a ground elastic material selected from the group consisting of a polyisoprene, latex, natural rubber, and synthetic rubber.

17. The softball training ball of claim 15, wherein the ball has a weight of about 177 grams to about 198 grams.

18. The softball training ball of claim 15, wherein the ball has a circumference of about 10 inches to about 12.5 inches.

19. The softball training ball of claim 15, wherein the plurality of pads consists of twelve pads and each pad has a pentagonal shape.

20. The softball training ball of claim 15, wherein the ball has a weight of about 167 grams to about 174 grams.

* * * * *